US011027172B2

(12) United States Patent
Osbrink

(10) Patent No.: US 11,027,172 B2
(45) Date of Patent: Jun. 8, 2021

(54) DEVICE AND METHODS FOR IMPROVED RESISTANCE TRAINING

(71) Applicant: Thomas W. Osbrink, Upland, CA (US)

(72) Inventor: Thomas W. Osbrink, Upland, CA (US)

( * ) Notice: Subject to any disclaimer, the term of this patent is extended or adjusted under 35 U.S.C. 154(b) by 0 days.

(21) Appl. No.: 16/362,502

(22) Filed: Mar. 22, 2019

(65) Prior Publication Data

US 2019/0290962 A1 Sep. 26, 2019

Related U.S. Application Data

(60) Provisional application No. 62/793,275, filed on Jan. 16, 2019, provisional application No. 62/646,922, filed on Mar. 23, 2018.

(51) Int. Cl.
*A63B 24/00* (2006.01)
*A63B 21/04* (2006.01)
(Continued)

(52) U.S. Cl.
CPC ..... *A63B 24/0062* (2013.01); *A63B 21/0442* (2013.01); *A63B 21/0552* (2013.01); *A63B 21/4035* (2015.10); *A63B 23/03508* (2013.01); *A63B 23/1281* (2013.01); *A63B 2024/0068* (2013.01); *A63B 2071/0658* (2013.01); *A63B 2220/51* (2013.01); *A63B 2225/02* (2013.01); *A63B 2225/20* (2013.01)

(58) Field of Classification Search
CPC ..... A63B 24/0062; A63B 21/0442; A63B 21/0552; A63B 21/4035; A63B 23/03508; A63B 23/1281; A63B 2225/02; A63B 2071/0658; A63B 2220/51; A63B 2024/0068; A63B 2225/20; A63B 2220/62; A63B 2225/09; A63B 2071/0655; A63B 2220/80; A63B 2220/17; A63B 24/0087; A63B 2225/50; A63B 71/0622; A63B 2220/833; A63B 2209/10; A63B 2220/803; A63B 2220/30; A63B 2071/0625; A63B 71/0669; A63B 2225/685; A63B 2220/20; A63B 21/00–00043; A63B 21/02; A63B 21/00061–00069; A63B 21/00185; A63B 21/05–0557
See application file for complete search history.

(56) References Cited

U.S. PATENT DOCUMENTS 4,493,485 A 1/1985 Jones
8,192,337 B2 6/2012 Birch
(Continued)

*Primary Examiner* — Andrew S Lo
(74) *Attorney, Agent, or Firm* — Morrison & Foerster LLP

(57) ABSTRACT

An exercise device in accordance with the present disclosure may include a body having a first end and a second end, wherein a first end is configured to receive a handle attachment. The exercise device may also include a first connection component disposed at the second end of the body and configured to attach the exercise device to a first resistance component. A sensor may be coupled to the first connection component. Additionally, a processing circuit may be disposed in the body of the exercise device communicatively coupled to the sensor. The exercise device may include a rotatable display configured to be visible to a user as a user performs movements with the exercise device.

9 Claims, 20 Drawing Sheets

(51) Int. Cl.

| | |
|---|---|
| ***A63B 21/055*** | (2006.01) |
| ***A63B 21/00*** | (2006.01) |
| ***A63B 23/035*** | (2006.01) |
| ***A63B 23/12*** | (2006.01) |
| ***A63B 71/06*** | (2006.01) |

(56) References Cited

U.S. PATENT DOCUMENTS

| | | | | |
|---|---|---|---|---|
| 8,491,446 | B2 | 7/2013 | Hinds | |
| 8,657,727 | B1 | 2/2014 | Kassel | |
| 8,827,815 | B2 | 9/2014 | Burroughs | |
| 9,381,420 | B2 | 7/2016 | Burroughs | |
| 9,411,940 | B2 | 8/2016 | Burroughs | |
| 2008/0204225 | A1* | 8/2008 | Kitchen | A63B 24/00 340/539.22 |
| 2012/0323496 | A1 | 12/2012 | Burroughs | |
| 2014/0221164 | A1* | 8/2014 | Siniora | A63B 71/0622 482/46 |
| 2014/0228985 | A1* | 8/2014 | Elliott | G06F 19/3481 700/91 |
| 2014/0323271 | A1* | 10/2014 | Hinds | A63B 21/0555 482/8 |
| 2015/0170530 | A1* | 6/2015 | Damman | G09B 5/00 700/91 |
| 2015/0297128 | A1* | 10/2015 | Shield | A63B 21/0442 600/595 |
| 2016/0038788 | A1* | 2/2016 | McMillan | G01L 5/03 73/488 |
| 2016/0220863 | A1* | 8/2016 | Braier | A63B 23/16 |
| 2017/0239551 | A1* | 8/2017 | Pease | A63B 24/0062 |

* cited by examiner

DEVICE AND METHODS FOR IMPROVED RESISTANCE TRAINING

CROSS REFERENCE TO RELATED APPLICATIONS

This application claims the benefit under 35 U.S.C. § 119(e) of U.S. Provisional Patent Application No. 62/646,922, filed Mar. 23, 2018 and U.S. Provisional Patent Application No. 62/793,275, filed Jan. 16, 2019; the content of which is incorporated by reference herein in its entirety for all intended purposes.

FIELD OF THE DISCLOSURE

This relates generally to a device and methods for performing resistance training. More specifically this application relates to exercise devices containing load sensors and displays for monitoring user performance during exercise.

BACKGROUND OF THE DISCLOSURE

Strength training can require the ability to measure and track incremental gains in weight lifted during successive exercise sets. Research has shown that "time-under-tension", or "hold time" is an important component of strength training. Thus, while exercising and strength training, it can be desirable to monitor exercise metrics such as hold time, time-under-tension, peak force, and rate of force development (RFD). Proper exercise cadence is difficult to maintain while tracking incremental gains without assistance, such as having a personal trainer monitor hold time during an exercise set.

Current strength training methods are insufficient in tracking and measuring incremental gains. For example, conventional free weights are often used to track incremental strength training improvements as they are sold in fixed weight increments, but are expensive, cumbersome, and suffer from the inertia issue. Specifically, the inertia of free-weights has been known to cause injury. For explosive movements, the rapid acceleration of the mass must be met by an equal deceleration at the end of the movement, possibly causing jerk to joints and muscles. The movement must then devote some range of motion to this deceleration stage. Indeed, studies report that nearly ninety percent of gym injuries come from dumbbells and barbells, with sixty-five percent of gym injuries stemming from dropping the dumbbell or barbell.

Resistance generators such as elastic resistance bands may also be used in exercise and rehabilitation settings, e.g., occupational and physical therapy, because of their low cost, portability, and relative safety. But the lack of measuring and tracking of equivalent weight precludes specific prescriptions for a patient's rehabilitation exercise routine, as well as recommendations in strength training. Specifically, elastic resistance bands are not equipped for measuring the equivalent weight applied during exercise that is required for tracking incremental gains.

It would therefore be useful to have an exercise device, which could provide a user with feedback related to the current weight applied by a resistance generator while monitoring time under tension during an exercise. It would also be useful to have an exercise device which could determine RFD for a full range of motion with multiple movement angles that is not subject to the inertia issue and that is capable of measuring the force applied to the exercise device.

BRIEF SUMMARY OF THE DISCLOSURE

The invention disclosed herein overcomes the shortcomings of the prior art by providing an exercise device containing a load measuring sensor, display, and user feedback which allows for tracking of applied weight and exercise set statistics, along with programmed weight and time-under-tension targets, RFD tracking, and the ability to communicate accumulated data via wireless means to an external computing device.

The present invention includes a method for calibrating attached resistance generators to ensure subsequent exercise repetitions reach the target weight as displayed by the exercise device.

According to a first embodiment, the device includes a single grasping handle built into the chassis body with a display set at an angle to the plane of the chassis body to facilitate viewing.

According to another embodiment, the device includes a horizontal grasping bar of such length as to facilitate two-hand exercises with a display set at an angle to the plane of the chassis body to facilitate viewing.

According to another embodiment, the device includes a flexible strap and fastening device used to connect the device directly to a user's appendage with a display embedded into the surface of the device.

According to another embodiment, the device includes two load connection points to allow the device to be connected in-line with a resistance generating source with a display embedded into the surface of the device.

According to another embodiment, the device includes an exercise device configured to be attached to a load measuring sensor, display, and user feedback which allows for tracking of applied weight and exercise set statistics, along with programmed weight and time-under-tension targets, and the ability to communicate accumulated data via wireless means to an external computing device.

According to another embodiment, the exercise device is configured to include a rotatable display. The rotatable display may be configured to be visible to a user while performing movements with the exercise device.

In some embodiments the exercise device is configured to calculate an RFD corresponding to a movement performed by the user where the force is independent of gravity. In some embodiments, the movement may be performed with an elastic band attached to the exercise device. According to some embodiments, the RFD may be calculated for multiple movement angles.

The RFD may be determined by the exercise device based on a change in force over time. In some embodiments the RFD may be determined based on a change in position of the exercise device over time. In some embodiments, the RFD may be determined based on the velocity of the exercise device. In some embodiments, a user may perform a two handed exercise an exercise device measuring exercise metrics for each hand.

One skilled in the art will understand that a device in accordance with embodiments of this disclosure may be practiced with a combination of the embodiments described above, for example, a rotatable display with wireless communication capabilities.

DETAILED DESCRIPTION OF THE INVENTION

In the following description of examples, reference is made to the accompanying drawings which form a part hereof, and in which it is shown by way of illustration specific examples that can be practiced. It is to be understood that other examples can be used and structural changes can be made without departing from the scope of the disclosed examples.

Figure 1:
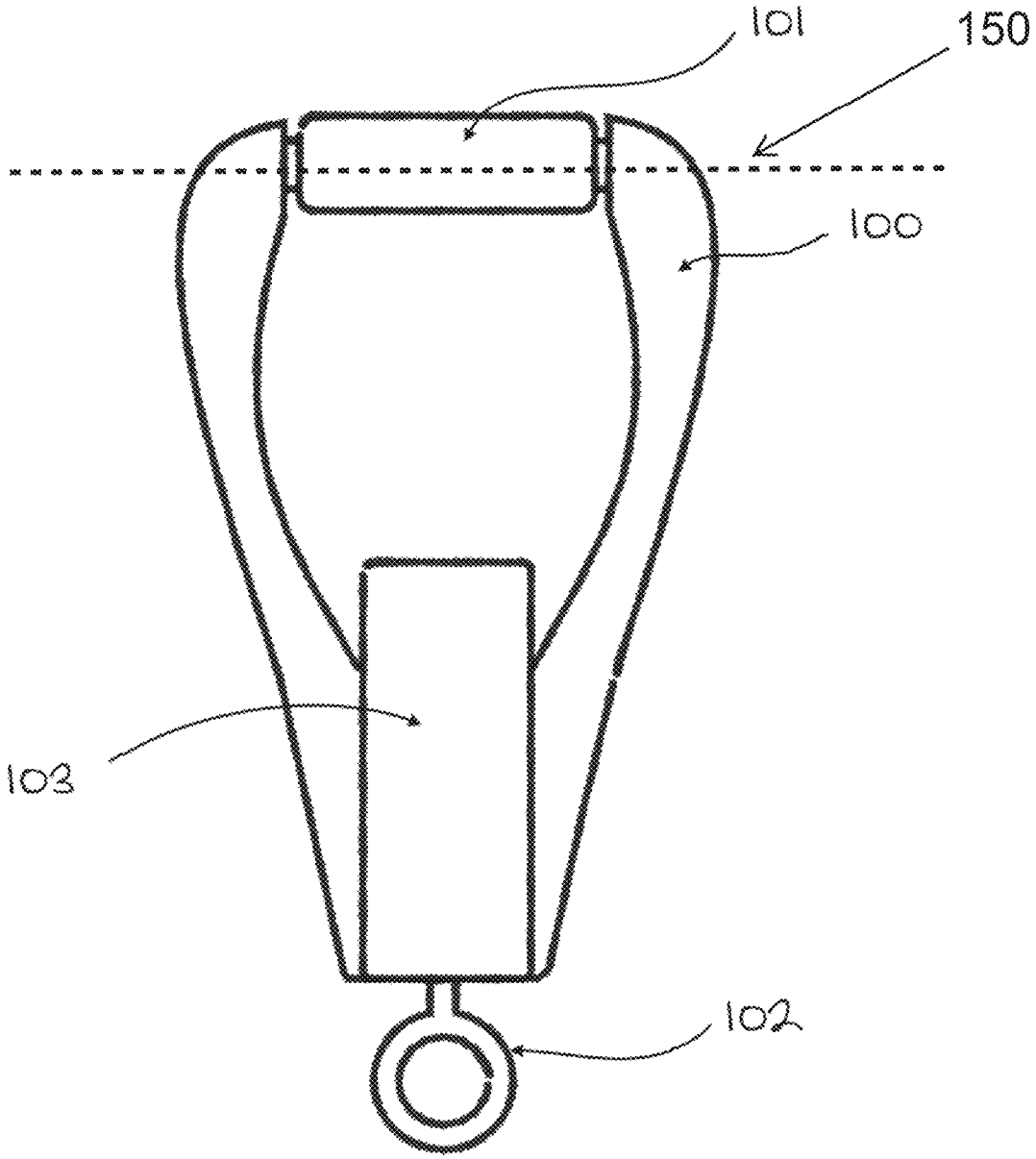
FIG. 1 is a front orthogonal view of an exercise device in accordance with embodiments of the present disclosure.

FIG. 1 is an exercise device in accordance with embodiments of the present disclosure, featuring a chassis body assembly 100 attached to a rotating grip assembly 101, display housing 103 and a load connection ring 102. Specifically, the device includes a single-grip in which the chassis body 100 extends in a yoke which is terminated by a rotating grip assembly 101 that is held by the user during exercise motions. The grip rotates about a horizontal axis 150 so as to reduce tension and fatigue on the wrist joints caused by torsional forces as the device is raised and lowered. A load connection ring 102 provides a simple connection method for many existing exercise tubing and cable machines which employ carabiner-style connection device. One skilled in the art will understand that the load connection ring 102 is not limited to circular shapes, but may also be ellipsoid, triangular, or any suitable shape known in the art. The load connection ring 102 also allows for some freedom of movement of the grip assembly off the direct axis of applied force.

A display housing 103 protrudes from the surface of the body 100. The display housing 103 includes a display screen (not shown). The display housing is positioned to have the display screen at an angle with the surface of the chassis body 100 that allows a view of the display when viewing the back or top of the exercise device. This allows the display to be visible during the transit of numerous exercise geometries.

Figure 2:
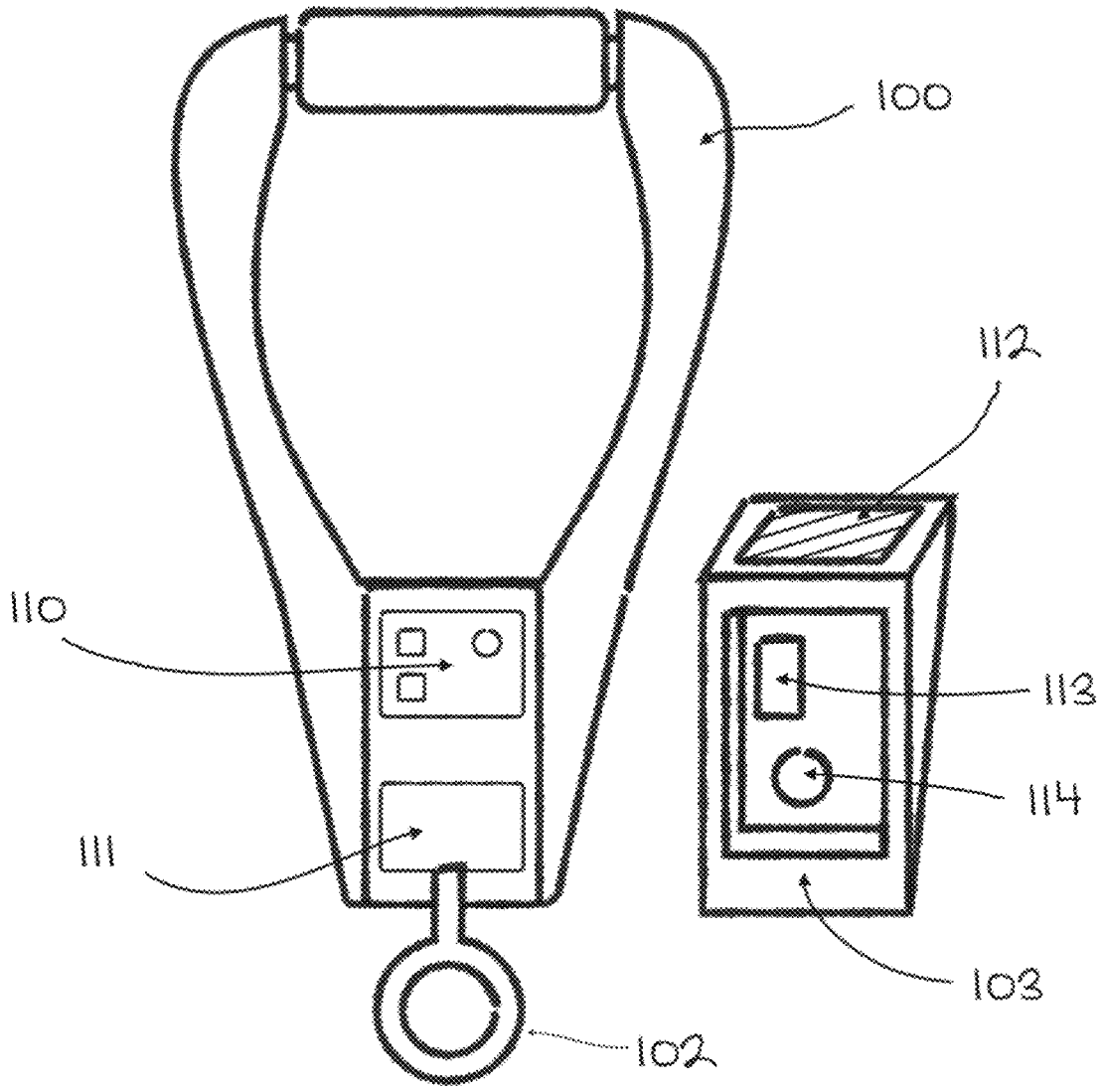
FIG. 2 is a front view of an exercise device in accordance with embodiments of the present disclosure.

Referring to FIG. 2, a front view of the exercise device 100 with the display housing detached is illustrated according to embodiments of the present disclosure. The lower body portion of the exercise device 100 disposed beneath the display housing 103 has a control card assembly 110 and a load cell 111 attached to the load connection ring 102 nested therein. The control card assembly 110 is communicatively coupled to the load cell 111. The load cell 111 translates the force applied to the mechanically coupled load connection ring 102 as an electric signal that is read by the control card assembly 110. In some embodiments, additional sensors, e.g., a linear displacement sensor or an accelerometer, may also be disposed in the area housing the control card assembly 110 and load cell 111. The additional sensors may be communicatively coupled to the control card assembly.

FIG. 2 also shows the display housing 103 in perspective view to show the angle of the display 112 with relation to the plane of the chassis 100. The display housing 103 includes a display 112, a rechargeable battery pack 113 and vibration motor 114. The display 112 provides a user with an interface to interact with the exercise device 100. The rechargeable battery pack 113 provides power to the exercise device. The vibration motor 114 may provide haptic feedback to a user. An audio feedback device may be located on the control card assembly 110.

Figure 3:
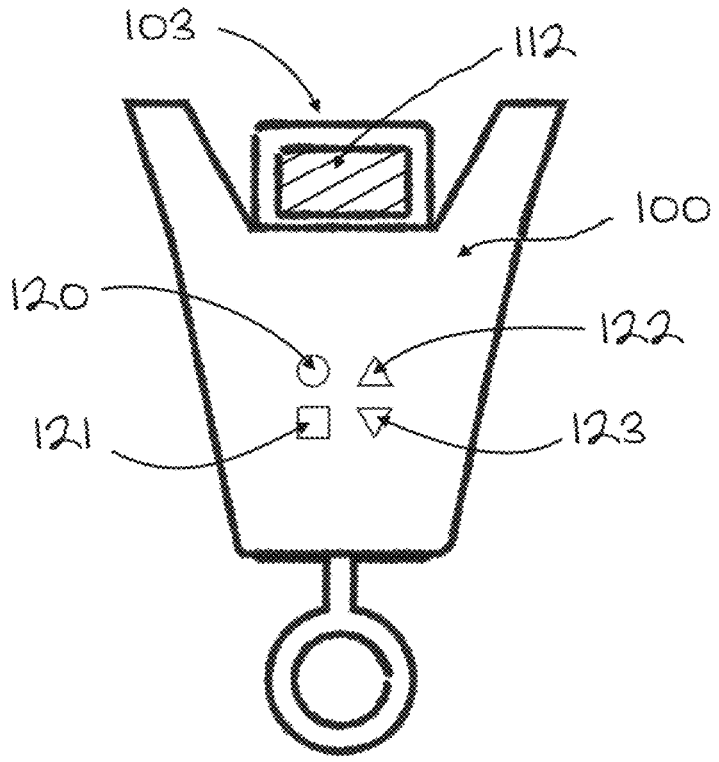
FIG. 3 is a rear truncated view of the exercise device in accordance with embodiments of the present disclosure.

FIG. 3 shows a zoomed in rear view of the chassis 100. The rear face of the chassis 100 includes placement of four user interface buttons within the chassis 100, consisting of a power control 120, mode control 121, decrease setting 123, and increase setting 122 buttons. These buttons translate logic ON/OFF levels to the control card assembly 110 contained within the chassis and control execution of the programmed functions. This view also shows the display assembly 103 and display 112 visible between the yoke of the chassis 100, for viewing while manipulating the buttons.

Figure 4:
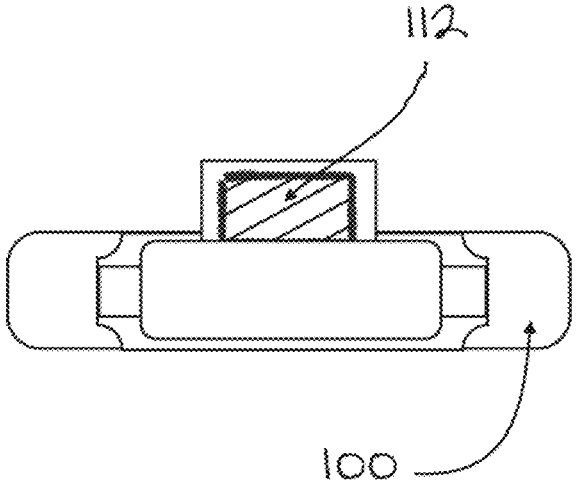
FIG. 4 is a top view of the exercise device in accordance with embodiments of the present disclosure.

A common viewing axis is shown in FIG. 4, where the user is looking down on the top of the device and the display 112 remains visible due to its outward projection and angle from the chassis body 100.

Figure 5:
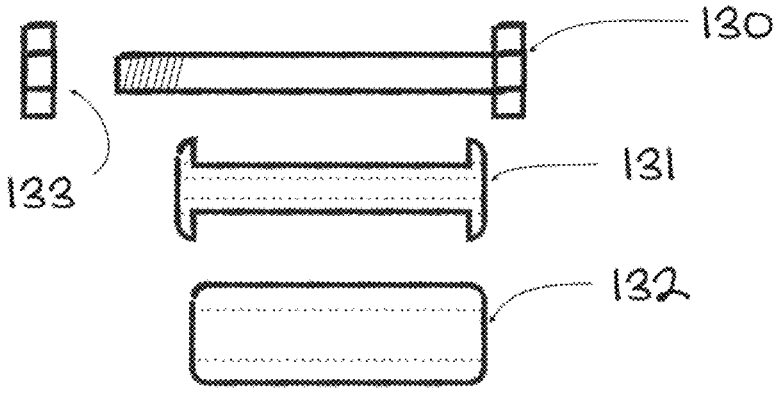
FIG. 5 is an exploded view of the rotating grip assembly of the exercise device in accordance with embodiments of the present disclosure.

A rotational grip assembly 101 is shown disassembled in FIG. 5 consisting of a long fastener 130 which passes through the upper end of the chassis body 100 yoke. A plastic spindle 131 slides over the shaft of the fastener 130 to reduce friction during rotational movement and to provide a rigid platform for installation of the pliable grip tube 132. The grip tube 132 provides an ergonomic gripping surface to reduce hand fatigue during exercise. The assembly 101 is secured with a nut 133 on the other side of the yoke from the fastener head.

Figure 6:
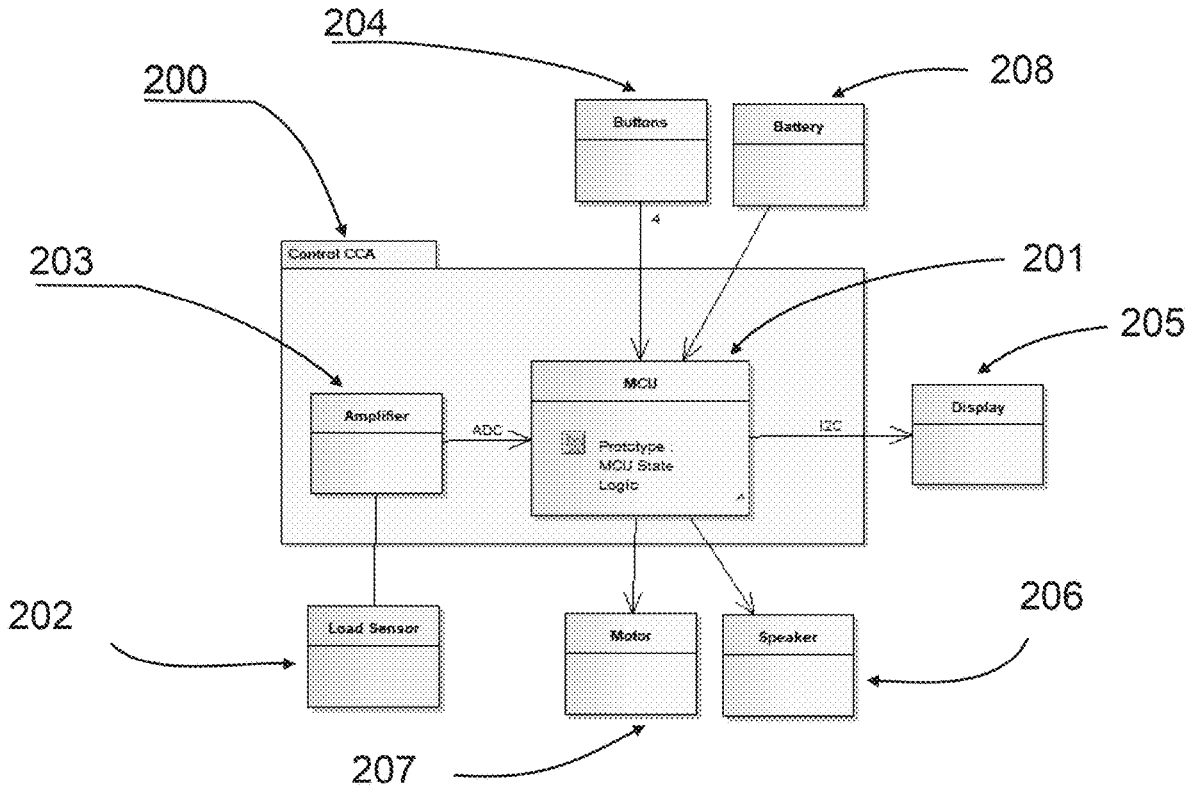
FIG. 6 is a block diagram of the exercise device in accordance with embodiments of the present disclosure.

FIG. 6 depicts the interconnection of circuits within the device, which is centralized to the control card assembly 200. Two key elements within the control card are the microcontroller unit (MCU) 201 which executes the firmware code critical to the operation of the device's digital features, and an instrumentation amplifier 203 which is used to amplify and buffer the analog signal originating from the Load Sensor 202. The MCU 201 uses an internal analog-to-digital converter [ADC] to translate the signal from the amplifier 203 into a digital word that can be used by the controller code. In some embodiments additional sensors are communicatively coupled to the MCU 201. The additional sensors may include, for example, an accelerometer or a linear displacement sensor. The signal from the additional sensors may be processed through an amplifier and ADC as described above with respect to the load sensor 202.

User interface buttons 204 directly translate logic levels to the MCU 201, which affect the programmed settings and state of the device. A battery 208 is provided which powers all digital features of the design. The display 205 is connected to the MCU 201 via a serial bus, in this embodiment, using the I2C protocol. At various stages throughout its operation, the MCU provides user feedback through the display 205, speaker 206, and motor 207. The speaker allows key states to be translated to the user without the need for the user to maintain eye-contact on the display. This makes exercises more natural once the device is set and "calibrated", so the user simply lifts until the beep is heard. Equally, time-under-tension goals are simple to communicate with a second beep, preferable of different frequency or tone pattern, to indicate the user has reached the goal and may relax that repetition. A vibration motor 207 is provided for environments in which haptic feedback is preferred, such as noisy environments where the alert cannot be heard, or would be confused with other users employing the same feedback method, for quiet environments, or with users that are hard of hearing. The motor causes a vibration against the chassis body 100 which translates into the grip assembly 101 to be felt by the user. The motor may vibrate for a different duration to indicate time-under-tension goals or when a user reaches a target weight goal.

Figure 7:
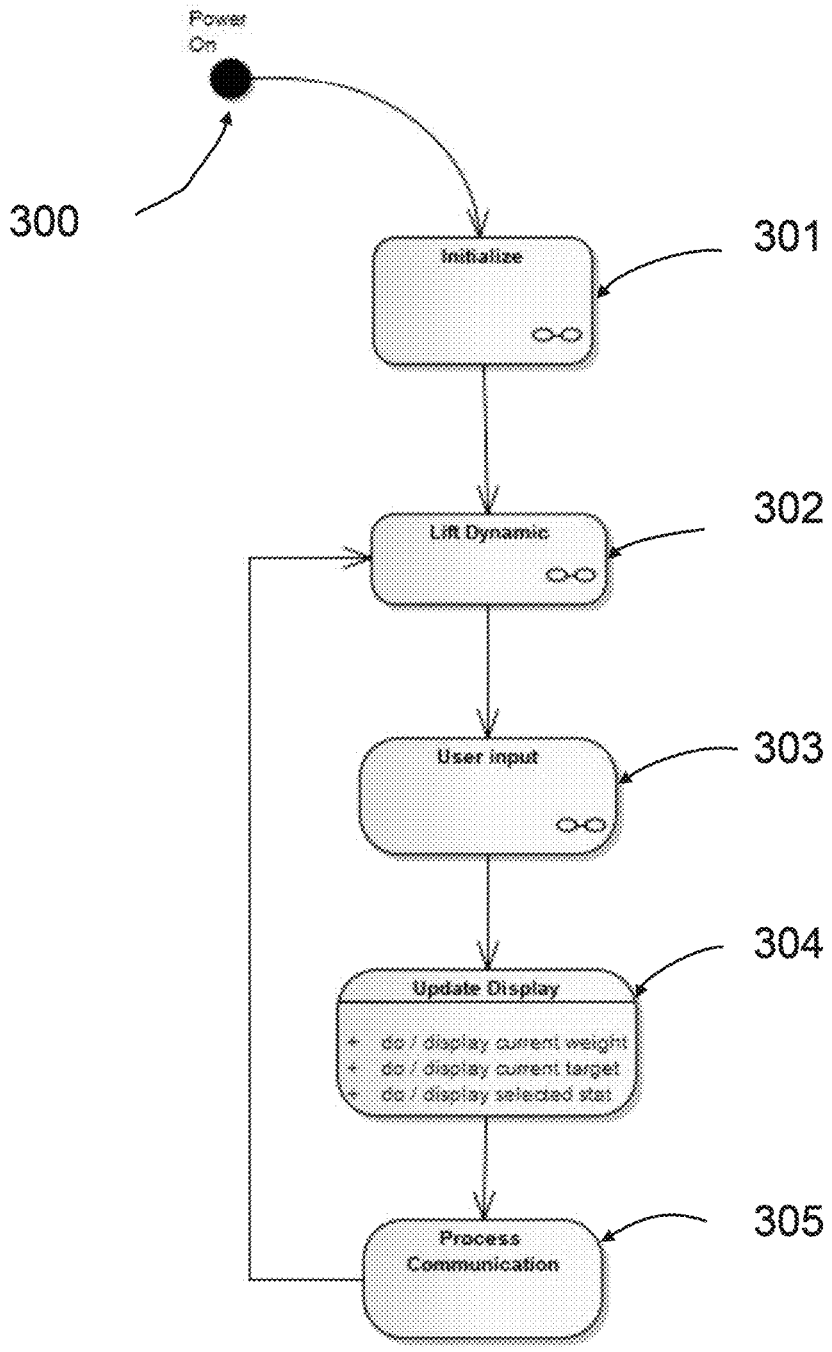
FIG. 7 is a flow chart of the logic loop of the processing unit of an exercise device in accordance with embodiments of the present disclosure.

Once powered on, the MCU 201 executes a set of instructions that are depicted in the flowchart of FIG. 7. Each time power is applied to the unit 300, the MCU begins by initializing the onboard features 301. This consists of assigning the IO pins, setting up the clock and timers, and initializing the display. The remaining four functions 302-305 are repeated in a continuous loop after initialization. First, the lift dynamics 302 are calculated. This function starts by reading the weight reported by the load cell 202 and determining the current state of the lift, which will be explained in more detail in the discussion of FIG. 10. The internal state logic also looks for transitions to count the number of exercise repetitions within an exercise set.

User input switches are polled 303 to determine changes in operating state. All buttons are debounced in software using a counter to ensure noise or sporadic signals do not trigger unintended operation. Weight, time-under-tension targets, and rate of force development (RFD) settings, can be programmed via this method by the user. Aspects of this user interface are discussed in more detail under the heading Method of Calibrating Resistance.

Next, the display screen is refreshed 304 on preset loop intervals depending upon a refresh clock. Data is streamed from the MCU 201 to the display module 205 including the current weight applied to the device, target weight, and lift statistics. If the device is under tension, the time-under-tension timer will display the time since reaching the target weight. If the device is not under tension, the last value of the time-under-tension timer will be displayed.

The final step, Process Communication 305, sends and decodes packets from the wireless module and is discussed in greater depth under Wireless Communication.

Figure 8:
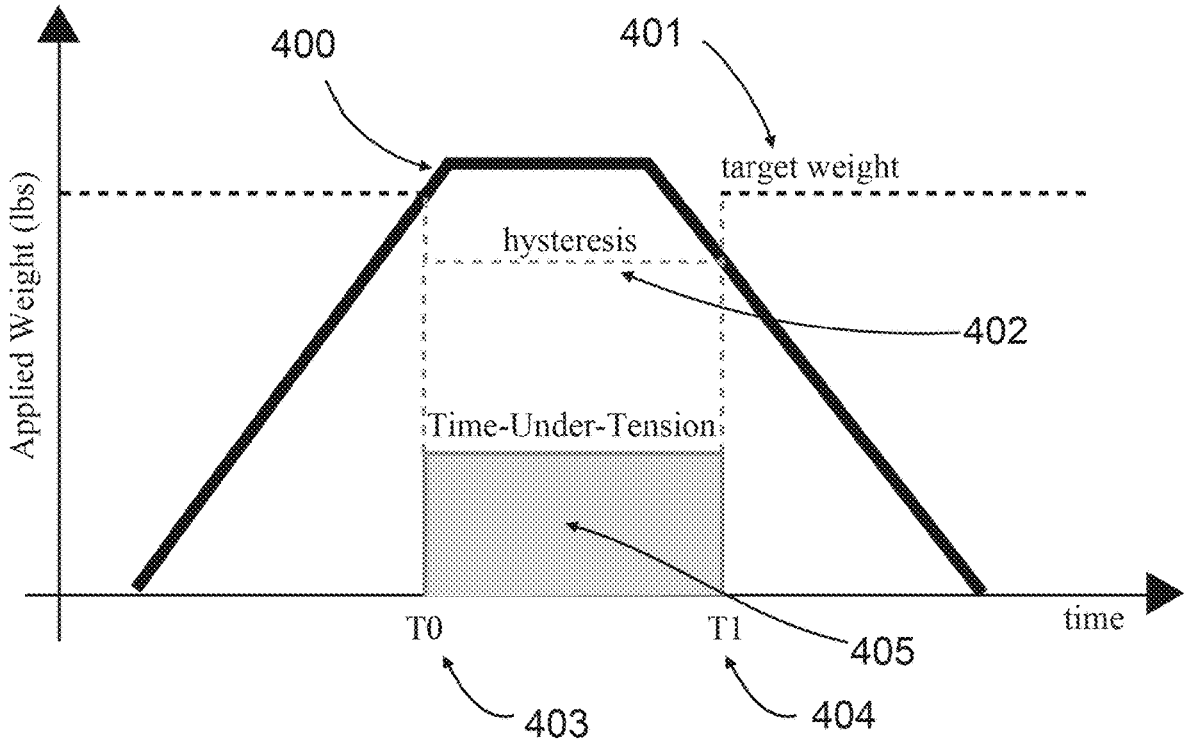
FIG. 8 is a graphic representation of a user "repetition" cycle in which the weight is lifted, held, and released.

A simulated weight-lift cycle is presented in FIG. 8, in which the weight applied to the device as it is lifted, held, and released 400 is plotted against time on the x-axis. A key to FIG. 8 is the concept of the target weight 401 which is entered by the user for the given exercise. When the applied weight reaches the target weight, two effects occur: a hysteresis value 402 is subtracted from the target to ensure system noise and variations in user force do not create the illusion of rapid repetition cycles, and the time-under-tension clock is cleared to zero 403 and starts incrementing. As the user relaxes the exercise and the applied weight 400 diminishes and crosses below the hysteresis level 402, the time-under-tension clock is stopped at T1 404 and the hysteresis is removed from the target weight threshold 401 for the next repetition. In some embodiments the hysteresis value may be set at a fixed weight, for example, two pounds. In some embodiments, the hysteresis may be a percentage of target weight, for example 1% to 10% of the target weight. One skilled in the art will understand that the hysteresis value is not intended to limit the scope of the present disclosure.

During the time-under-tension state 405, set statistics are monitored, including maximum applied weight and average applied weight while under tension. These statistics are made available to the user on the display.

Figure 9:
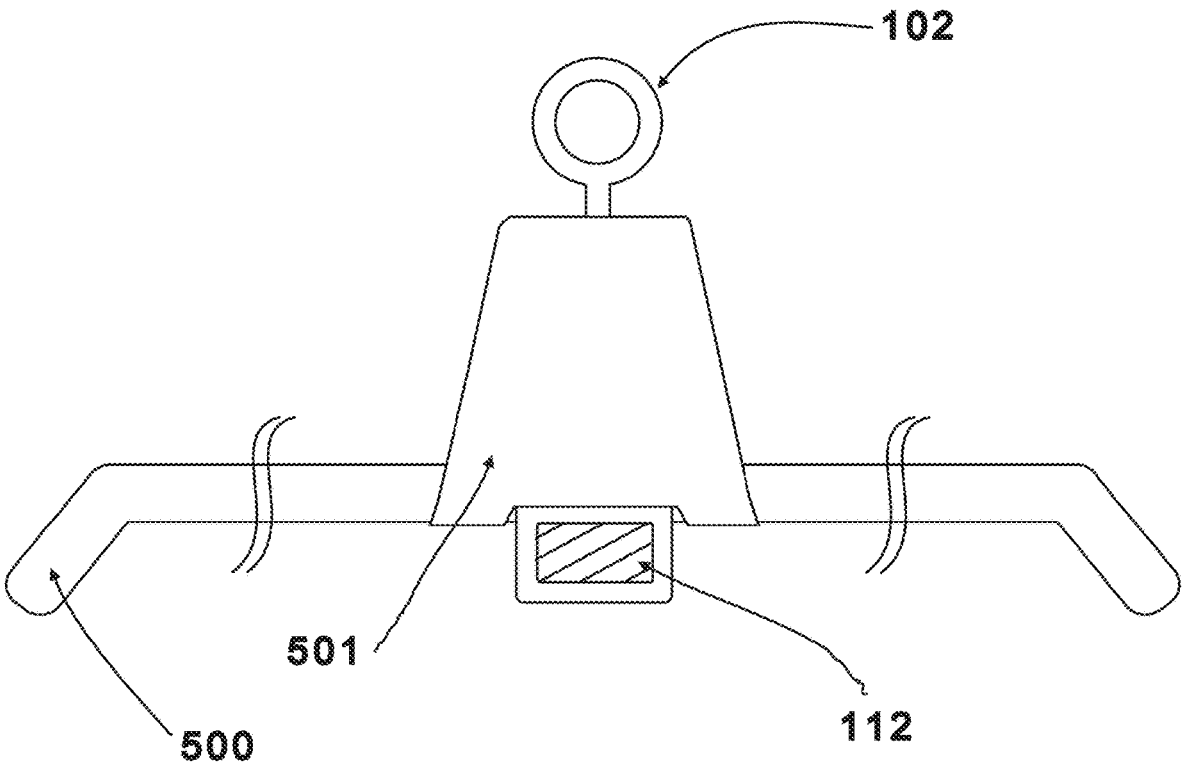
FIG. 9 is an exercise device in accordance with embodiments of the present disclosure.

Another embodiment of an exercise device in accordance with this disclosure is designed to facilitate exercises classically favoring a barbell, as shown in FIG. 9. A shortened chassis body 501 is connected to a long horizontal bar 500 with provision for grasping with a hand on either side of the chassis body 501. It is common for the extreme ends of such bars to be bent in at an angle to provide a more natural wrist angle when grasping the outer end of the bar. A display housing similar to the embodiment shown in FIG. 4 such as the screen 112 is viewable in a similar fashion from the front or bottom axes.

Figure 10:
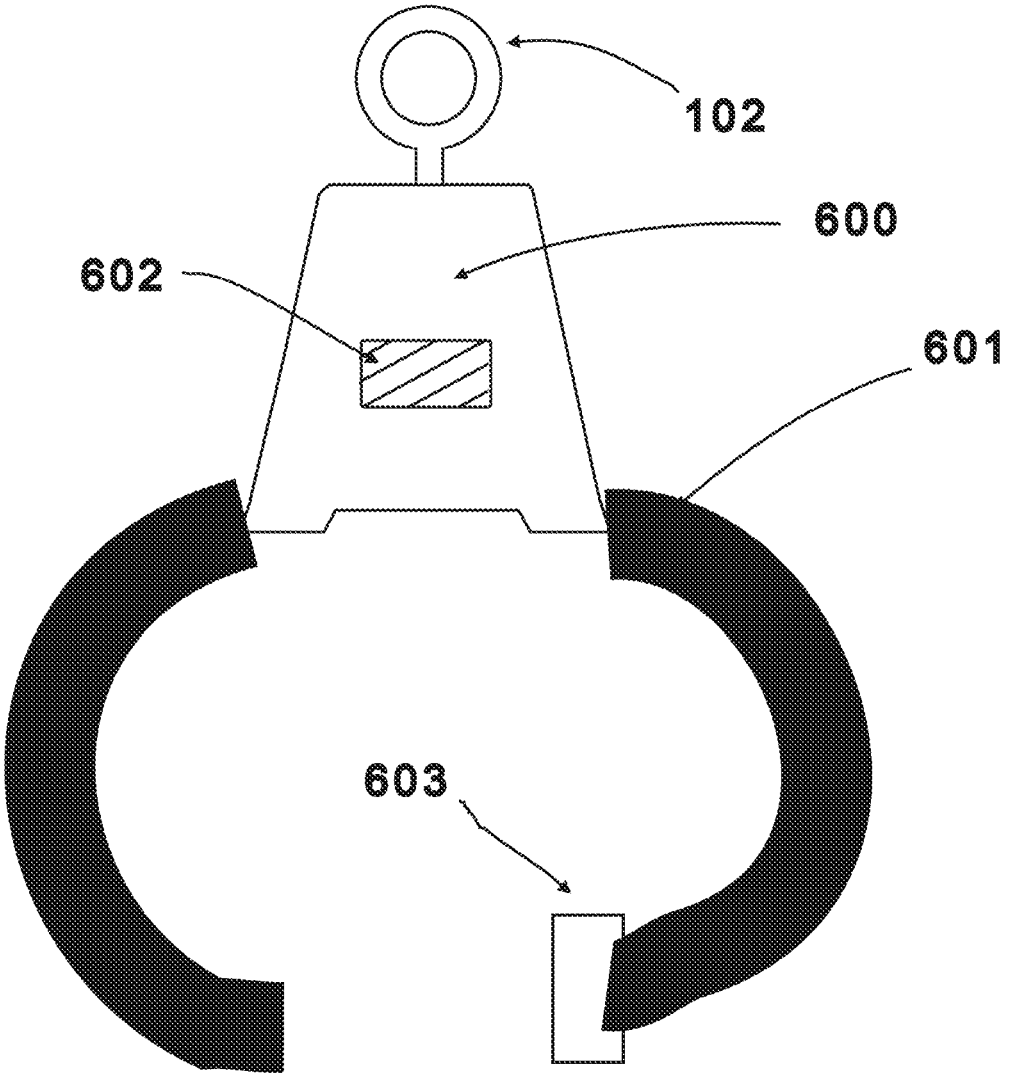
FIG. 10 is an exercise device in accordance with embodiments of the present disclosure.

Another embodiment of an exercise device in accordance with this disclosure is shown in FIG. 10. A shortened chassis body 600 is connected to a flexible strap 601 that can be wrapped around an appendage, such as an ankle or wrist. The strap is held in place by a fastening device 603, such as Velcro. Because this configuration is affixed in one plane with relation to the user, the display 602 is embedded into the chassis body 600 so as to face "up" when strapped to the user's appendage.

Figure 11:
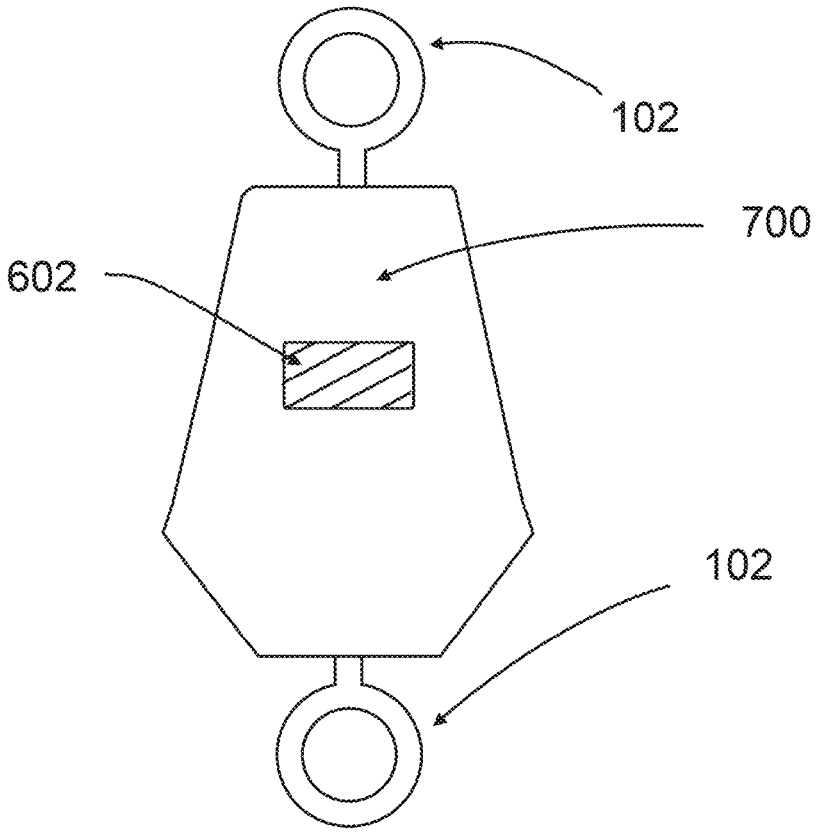
FIG. 11 is an exercise device in accordance with embodiments of the present disclosure.

Another embodiment of an exercise device in accordance with this disclosure is shown in FIG. 11, in which the exercise device is placed in line with the resistance generator. The shortened chassis body 700 terminates in two load hook rings 102, where one ring is connected to an internal load cell and the other is affixed to the chassis 7000. In a similar fashion to the embodiment of FIG. 10, an embedded display screen 602 is included in this design. This embodiment is designed for applications in which the user is not directly attached to or holding the device. Examples of such application include use in-line with a cable machine weight assembly.

Wireless Communication

There may be provided additional circuitry to the control card assembly 110 to facilitate wireless communication with an external computing device or mobile device. This circuitry may be included directly on the control card assembly 110 or provided as a "daughter card" which directly interfaces with the control card assembly 110. The protocol may be Bluetooth and allow for connection with a mobile device, such as phones, smart watches, computing tablets, and other smart devices. One or more of applied weight readings, time under tension timer value, target weight, target time-under-tension, accumulated set statistics recorded by the exercise device, and RFD can be available for communication to the external computing device.

In some applications, the need for a display attached to or integrated into the chassis body of the exercise device may be rendered unnecessary, and a remote display favored. In such an application, the external computing device connected wirelessly may take on all of the feature requirements of an attached display. As such, referring to FIG. 7, during the process communication step 305 of the firmware, packets of lift dynamic data can be encoded along with a unique time stamp to facilitate decoding and plotting by the computing device.

In addition to displaying current exercise device data, the communication channel can also be capable of transmitting commands from the external computing device back to the exercise device, simulating all user interface functions for mode control and setting increase and setting decrease.

In some embodiments, two or more exercise devices may be used simultaneously. The external computing device can be capable of synchronizing the operation of the two or more exercise devices. For example, the two or more exercise devices may receive configuration commands from the external computing device. Thus, features such as target weight would automatically change on the each exercise device when the user changes target weight on the first. The devices may send telemetry data to the external computing device for post-processing. According to some embodiments, a single user may use two exercise devices. For example, two single-grip configuration exercise devices may both are connected to the external computing device. In this manner, the exercise device may monitor separate movements of each hand.

In some embodiments, two or more exercise devices may be connected to an external computing device to monitor the activity of two or more different users. The two or more exercise devices may simultaneously connected to the external computing device and used simultaneously by two users in a competition mode. For example, two or more users may compete to determine which user can generate the highest peak force or which user has a longer time-under-tension. The results of the competition may be communicated to the external computing device. In some embodiments, the external computing device may display the results. In some embodiments, the external computing device may be in communication with a display device, which may act as a scoreboard. In some embodiments, the display device may update and display the results in real time.

According to some embodiments the external computing device may monitor the activity of at least a first and second user and compare the data from each user to rank users over a period of time. For example, the external computing device may monitor the activity of the first user performing a set of repetitions until exhaustion. The external computing device may monitor the subsequent activity of a second user performing a set of repetitions until exhaustion. The number of repetitions may be recorded and users may be ranked relative to each other. One skilled in the art will understand that the external computing device may be in communication with a plurality of exercise devices such that the external computing device can rank a plurality of users. One skilled in the art will understand that the external computing device may rank users performing various activities including a maximum number of repetitions for a pre-determined weight, maximum time-under-tension. In some embodiments, the rankings may be accessible through an application on an external computing device, such that multiple users can perform an activity with the exercise device. The exercise device may then be synchronized with an external computing device such that the user can track personal progress against other users.

Method of "Calibrating" Resistance

Figure 12:
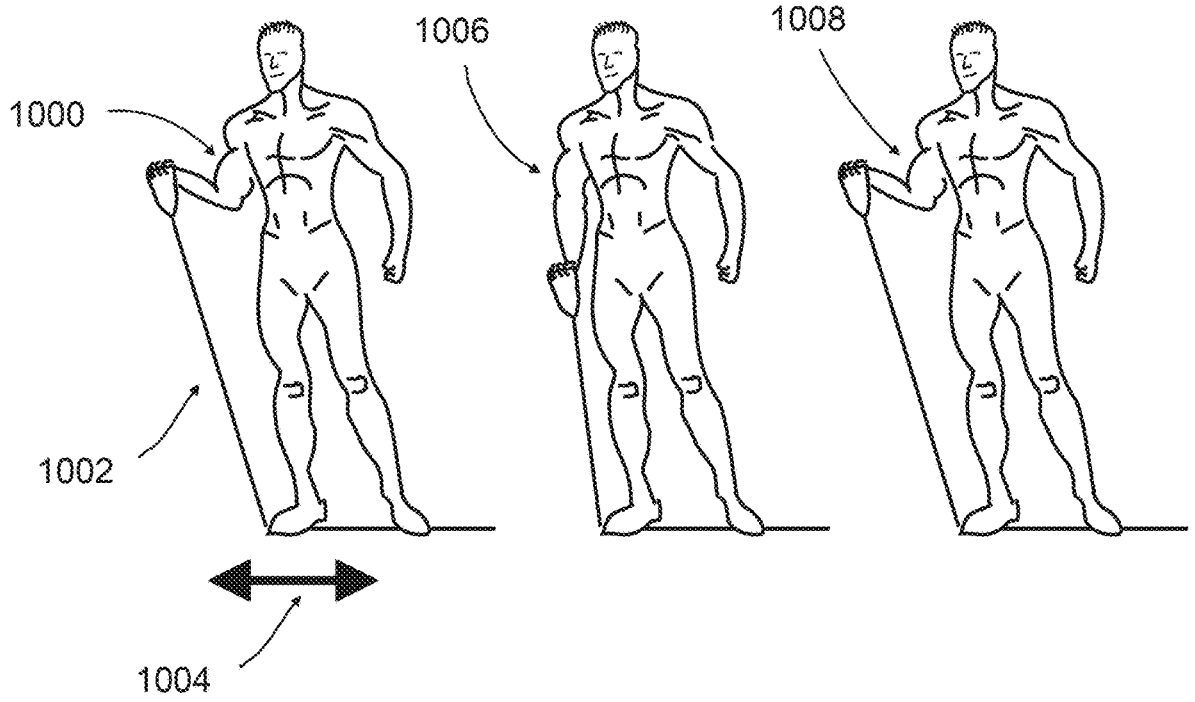
FIG. 12 illustrates a weight calibration method for a "bicep arm curl" exercise in accordance with embodiments of the present disclosure.

As discussed above, when using standard resistance bands or tubing, a user typically makes a qualitative determination as to the length of the band or tubing to produce the desired and relative difficulty of the exercise. According to embodiments of the present disclosure, the exercise device allows for a specific target weight to guide the calibration of the resistance band or tubing. The calibration method is depicted in FIG. 12 using a "bicep arm curl" as an example exercise use case with an unsecured exercise band.

The user programs the device for the desired target weight by entering the target weight into the exercise device with the buttons. The target weight may be a peak force under tension to be reached during an exercise movement with the exercise device. The user holds the exercise device that is attached to a resistance band 1002 in the peak movement of the exercise to be performed 1000. The weight detected by the exercise device depends on tension on the band 1002. To increase or decrease the tension, a user can move a foot along the length of the band 1004. The user adjusts the foot placement 1004 until the desired target weight is displayed on the exercise device. For example, if the user wants to increase the detected weight, the user may move his foot closer to the exercise device, thereby shortening the length of the band 1002 in tension. If the user wants to decrease the detected weight, the user may move a foot farther from the exercise device.

Once the user locates the position along the band that results in the target weight, the resistance is "calibrated". In some embodiments, once the exercise device determines that it is calibrated, the device may provide the user with audio or haptic feedback such as beeping or vibrating. Once the device is calibrated the user begins set repetitions by lowering the exercise device 1006 and raising it again to the peak movement of the exercise 1008. As the user performs repetitions, the user will receive feedback when the device reaches the target weight corresponding to the peak movement, as calibrated. In this way, the user may perform the repetitions and know the target weight has been reached without viewing the display. The feedback may be, for example, audio or haptic feedback. The audio feedback for the target weight may be differentiated from the time-under-tension goals by frequency, tone pattern, or duration. The haptic feedback for the target weight may be differentiated from the time-under-tension goals by duration or pattern of vibration. Because the band length was calibrated to produce the target weight 1000, it will continue to produce that target weight for each repetition return to the peak movement 1008.

Figure 13:
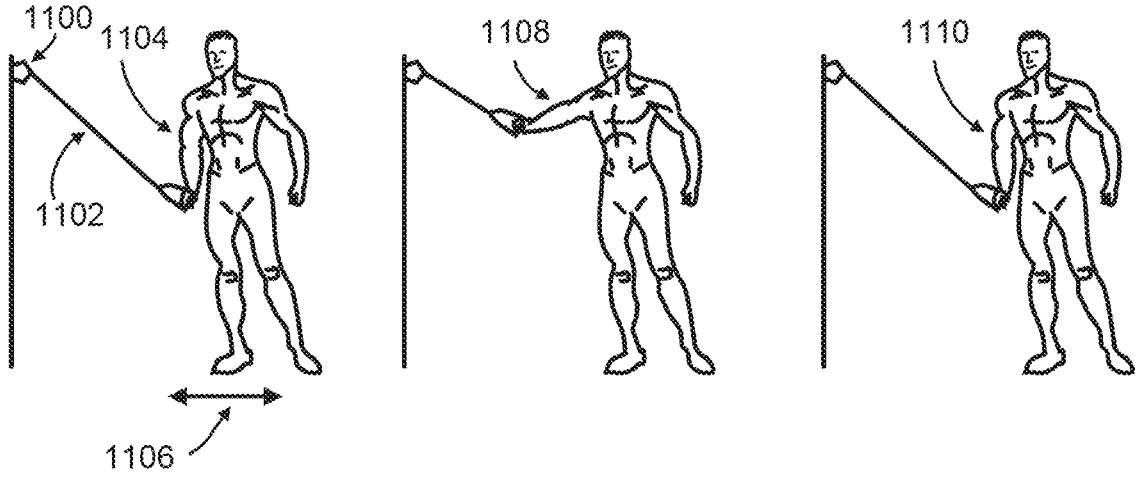
FIG. 13 illustrates a weight calibration method for a "straight-arm lat pull-down" exercise in accordance with embodiments of the present disclosure.

FIG. 13 shows an embodiment where the exercise device is calibrated while the elastic band is attached to an anchor-point secured to a surface. The calibration method depicted in FIG. 13 is for a "straight-arm lat pull-down". In this case, the elastic band 1102 is attached to an anchor point 1100 and is held down at the peak movement of the exercise 1104. The user adjusts the distance from the anchor point 1100 until the desired target weight is displayed on the exercise device, thereby "calibrating" the exercise device. For example, if the user wants to increase the detected weight, the user may move farther from the exercise device, thereby increasing the length under tension of the band 1002 for a repetition cycle. If the user wants to decrease the detected weight, the user may move closer to the exercise device.

Once calibrated, the user can perform set repetitions by raising the exercise device 1108 and lowering it again to the peak movement of the exercise 1110. Because the band length was calibrated to produce the target weight 1104, it will continue to produce that target weight for each repetition return to the peak movement 1110.

According to some embodiments the exercise device may be calibrated to determine an elastic modulus of an elastic resistance band attached to the exercise device. A user may use the exercise device to determine the elastic modulus of the elastic resistance band or resistance component. The user can hold the exercise device at a peak movement when the elastic resistance component is attached to the exercise device. The user can perform at least one repetition by raising the exercise device 1108 and lowering the exercise device 1110. During the repetition, the exercise device can detect a change in force and a change in position. The exercise device can use this data to determine an elastic modulus of the corresponding band. Each band may have a different elastic modulus, so this calibration may be performed multiple times. Alternatively, the elastic modulus of a band may be input into the device. The calibrated modulus may be used in RFD calculations described in more detail below.

Rotatable Display

Figure 14:
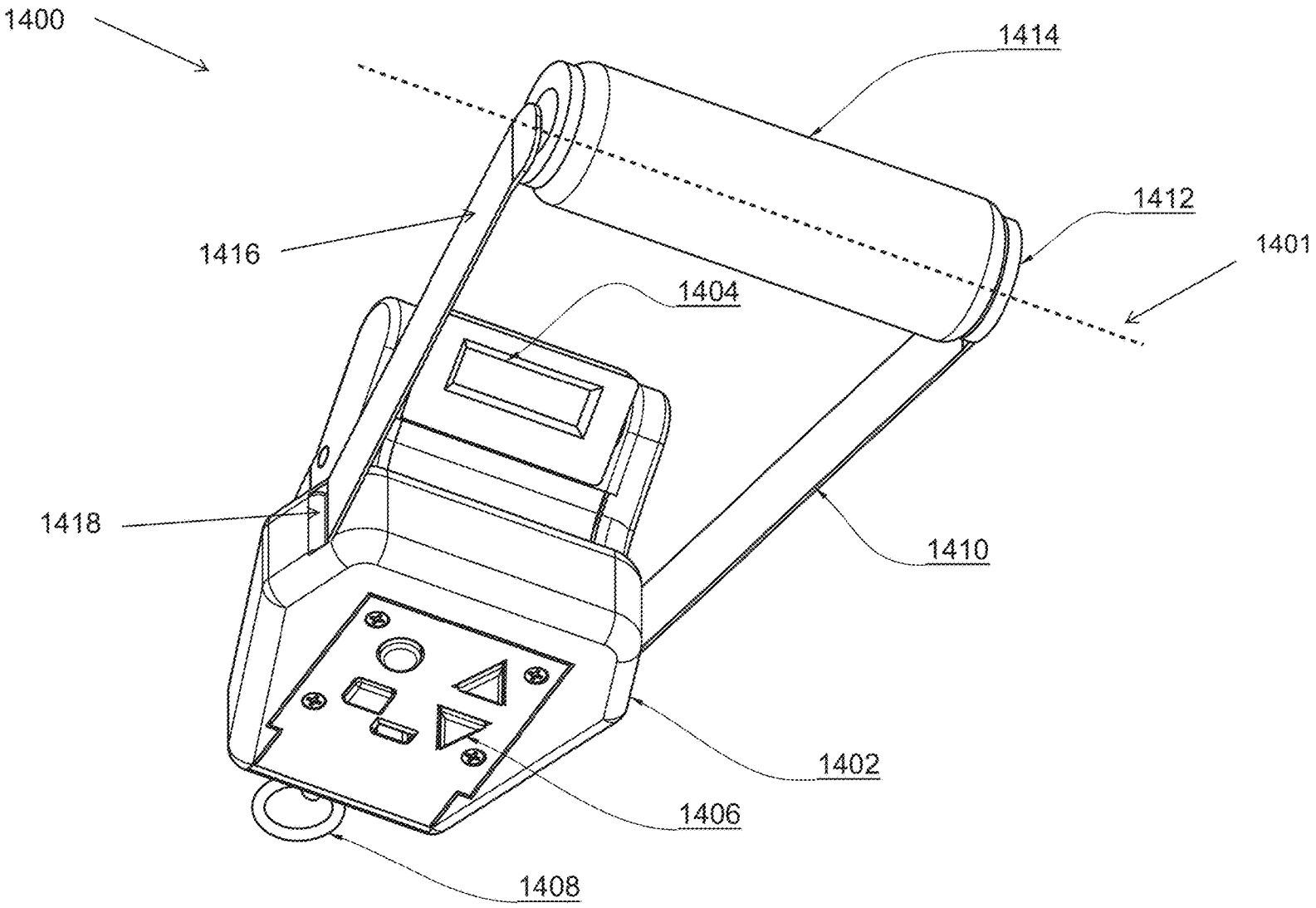
FIG. 14 is a perspective view of a device in accordance with embodiments of the disclosure.

FIG. 14 is a perspective view of an exercise device 1400 in accordance with embodiments of this disclosure. The exercise device 1400 includes a main chassis body 1402 that houses the electronic circuitry of the exercise device 1400. The exercise device 1400 includes a rotatable display 1404 that protrudes from the body 1402. A control panel 1406 is disposed on chassis body 1402. As shown in FIG. 14, the control panel 1406 is disposed on a face opposite the rotatable display 1404. The location of the rotatable display is not intended to limit the scope of this disclosure. For example, in some embodiments, the control panel may be disposed on the same face as the rotatable display. The control panel 1406 includes a plurality of buttons communicatively connected to the electronic circuitry of the exercise device. For example, the buttons may include a power button, a mode button, an up button and a down button. One skilled in the art will understand that the number and types of buttons are not intended to limit the present disclosure.

The main body 1402 is configured to receive a handle attachment at a first end of the main chassis body 1402. In some embodiments, the handle 1410 is a flexible handle. Specifically, the handle 1410 includes a flexible strap 1416, a handle spindle 1412, and a handle grip 1414. The flexible strap 1416 may be threaded through a pair of openings 1418 disposed at the first end of the body 1402. A handle spindle 1412 may be disposed on the flexible strap 1416, such that the flexible spindle 1412 is movable and rotatable relative to the body of the exercise device 1402 along the axis 1401. A handle grip 1414 is disposed over the spindle 1412 to provide a user with a comfortable or ergonomic grip while performing exercise movements with the exercise device 1400. In some embodiments the handle 1410 may be formed integrally with the exercise device 1400. In some embodiments, the handle 1410 may be detachable such that a user could provide a desired handle grip.

A connection component 1408 is disposed at a second end of the body 1402. The connection component 1408 is coupled to a load cell (not shown) that is communicatively coupled to the electronic circuitry of the exercise device 1400. In some embodiments, the connection component 1408 is a connection ring. In some embodiments, the connection component 1408 may be triangular, square, ellipsoid, or any other shape known in the art suitable for a connection component. The connection component 1408 is configured to be attached to a resistance component, for example, an elastic resistance component such as an elastic band.

Figure 15:
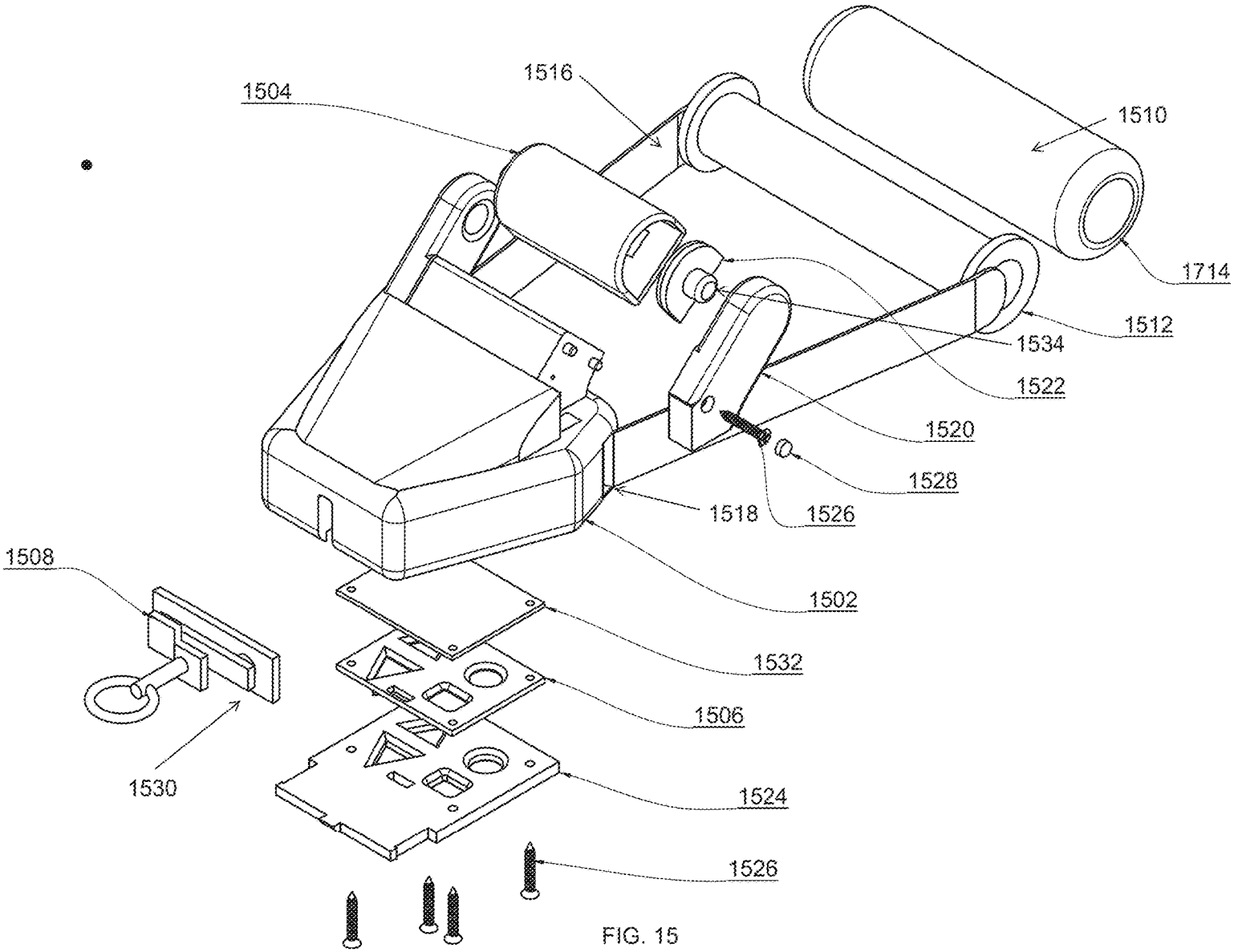
FIG. 15 is an exploded perspective view of a device in accordance with embodiments of this disclosure.

FIG. 15 is an exploded view of the exercise device 1500 in accordance with embodiments of the disclosure. The exercise device 1500 includes a main chassis body 1502 that houses the electronic circuitry of the exercise device 1500. The electronic circuitry includes processing unit 1532 that is communicatively coupled to the control panel 1506, load cell 1530, and display unit 1504. The processing unit 1532 includes at least one microcontroller unit. An audio feedback device may be included on the processing unit 1532. The electronic circuitry is disposed in a cavity of the main body 1502. In some embodiments, the electronic circuitry encompasses the block diagram shown and described with respect to FIG. 6. An outer cover 1524 is disposed over the control panel 1506 and processing unit 1532. A plurality of screws 1526 may be used to secure the processing unit 1532, the control panel 1506, and the cover 1524 to the body 1502.

The exercise device 1500 includes a rotatable display unit 1504 that protrudes from the body 1502. The display unit 1504 includes at least a display such as an LCD display. The display unit 1504 is attached to the body 1502 with at least one display arm 1520. The display arm 1520 may protrude from the body 1502 at a forty-five degree angle. In some embodiments, the display arm may protrude from the body 1502 at an angle in the range of thirty degrees to sixty degrees. The display arm 1520 provides a channel for a wired connection between the display unit 1504 and the processing unit 1532. The display arm 1520 is secured to the body 1502 with a plurality of screws 1526. A screw cap 1528 may be disposed over a respective screw 1526.

A display door 1522 is included at a first and second end of the display unit 1504. The display door 1522 provides access to the circuitry of the display unit 1504 (e.g., access to circuitry of the LCD display) and a wireway channel for a connection between the display unit 1504 and the processing unit 1532. The display door 1522 includes a protruding portion 1534, which provides a rotatable connection to a corresponding display arm 1520. The display unit 1504 is configured to rotate along at least one axis relative to the body 1502. According to another embodiment, the display unit 1504 may rotate along at least two axes relative to the body 1502. The rotatable aspect of the display unit 1504 allows the display unit 1504 to be visible to a user while the user performs a movement with the exercise device 1500.

In some embodiments, the exercise device 1500 includes a handle 1510 disposed at a first end of the body 1502. Specifically, handle 1510 is a flexible handle that includes a flexible strap 1516, a handle spindle 1512, and a foam grip 1514 disposed over the spindle 1512.

A connection component 1508 is disposed within the body 1502 such that a portion of the connection component is accessible from an outer surface of a second end of the body 1502. The connection component 1508 is configured to be attached to a resistance component, for example, an elastic resistance band. The connection component 1508 is coupled to a load cell 1530, such that the load cell 1530 can detect when the connection component 1508 is under tension or when the attached resistance component is under tension. The load cell is disposed in a cavity of the body 1502. The load cell is communicatively coupled to the electronic circuitry, e.g., the processing unit 1532.

The processing unit 1532 may be configured to determine a rate of force development, a time under tension, and/or maximum force based on a movement of the user. In some embodiments, the force generated in the connection component and detected by the load cell may be independent of gravity. This is because the force is generated by the tension in the elastic band. The movement of the user may be performed at multiple movement angles such that the force detected by the load cell corresponds to the movement in multiple movement angles. In some embodiments, the rate of force development may be calculated by measuring a force detected by the load cell over time. In other embodiments, the rate of force development can be calculated by measuring a displacement of the body 1502 of the exercise device 1500 corresponding to a change in length of a resistance component (not shown) attached to load ring 1508. Calculation of the rate of force development will be described later.

Figure 16:
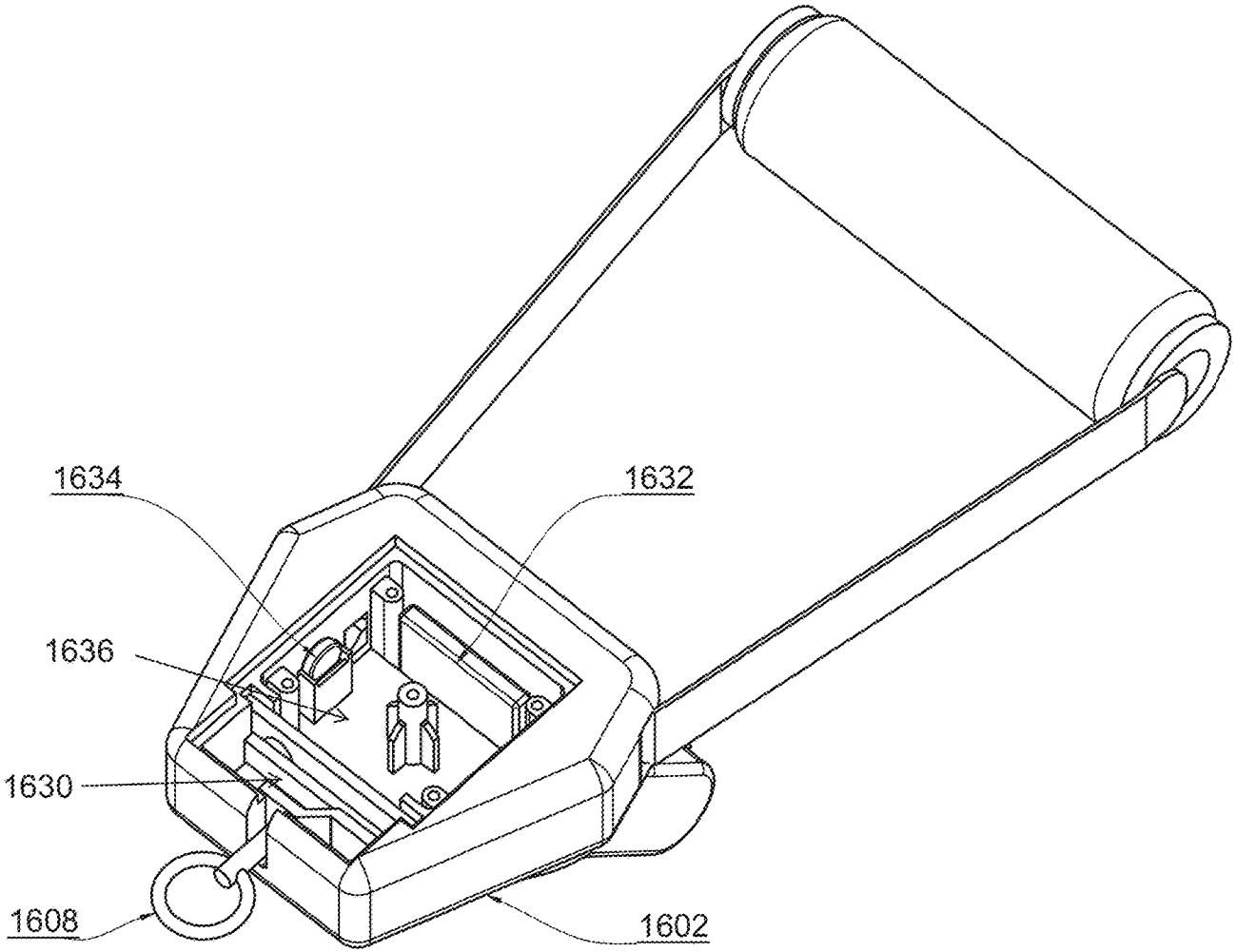
FIG. 16 is a perspective view of a device in accordance with embodiments of the disclosure.

FIG. 16 is a perspective view of an exercise device 1600, particularly of cavity 1636 of the body 1602. The cavity 1636 houses the electronic circuitry of the exercise device 1600. For example, processing unit (not shown), battery 1632, vibration motor 1634, and load cell 1630 operatively coupled to connection ring 1608 are disposed in the cavity 1636. An audio feedback device may be included on the processing unit 1632. In some embodiments, additional sensors such as an accelerometer or a linear displacement sensor are disposed in cavity 1636 and communicatively coupled to the processing unit 1632.

Rate of Force Development

RFD is a metric used to characterize how fast force develops during a movement. A high RFD is correlated with development of "fast-twitch" muscles, which contributes to "explosive movement" performed by an individual. A higher RFD is positively correlated with an athletic ability of the individual, e.g., a sudden cut to avoid a tackle for a football player, a take-off kick for a long jumper.

Figure 17:
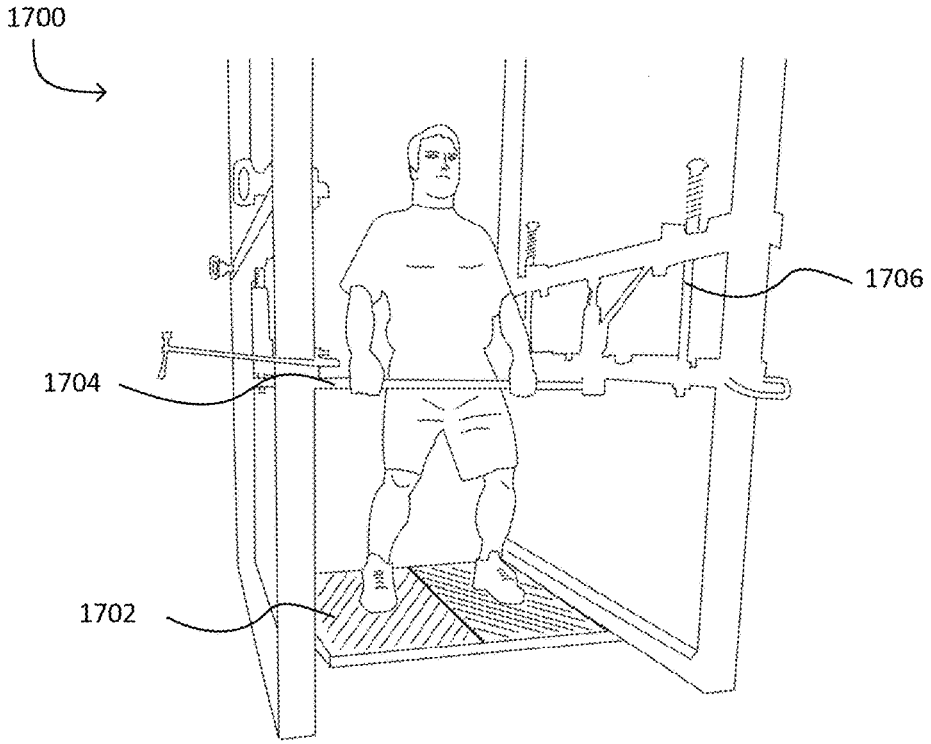
FIG. 17 is a platform apparatus.

RFD is calculated by measuring a change in force over time. Testing methods for measuring RFD include cumbersome devices, such as the isometric mid-thigh pull or a free-weight apparatus. FIG. 17 shows a platform apparatus 1700 used to measure RFD with the isometric mid-thigh pull method. A user stands on a platform 1702 while gripping a rigid bar 1704. The user pulls upward on the bar 1704. Restraints 1706 ensure that the rigid bar 1704 stays stationary within the platform apparatus 1700 while the user applies the force and a force is measured. The platform apparatus 1700 measures the applied force to calculate the RFD. The isometric mid-thigh pull method does not measure a full range of movement, multiple movement angles, or linear velocity of a movement because the force is measured with a stationary bar 1704.

Figure 18:
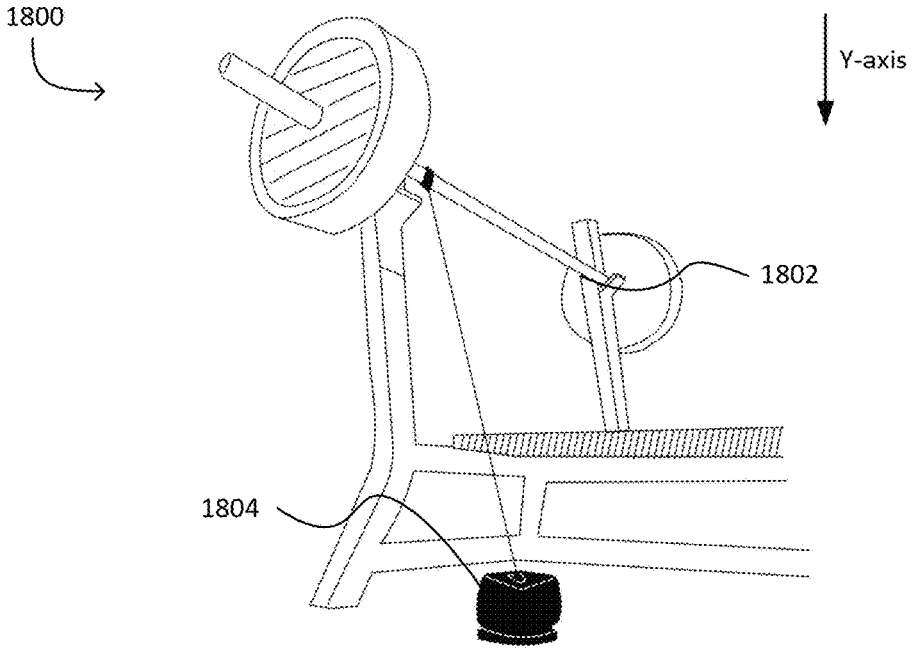
FIG. 18 is a free weight apparatus.

RFD can also be calculated with a free-weight apparatus 1800 as shown in FIG. 18. The free-weight apparatus includes a free-weight 1802 (e.g., a barbell or dumbbell) and a sensor 1804. A user lifts the free-weight 1802 and sensor 1804 translates a measured velocity into a RFD. RFD measurements with a free-weight apparatus 1800 are limited because RFD cannot be measured from multiple movement angles, is limited by an inertia issue, and does not measure the force applied to the free-weight itself. The free-weight apparatus measures RFD in the y-direction only because the force vector acting on the free-weight 1802 is downward in line with gravity.

An exercise device in accordance with embodiments of the present disclosure can be attached to an elastic resistance component. Elastic resistance bands are a staple in many sports training programs for providing resistance during the eccentric and concentric movements while overcoming the issue of inertia associated with traditional free weights. By using the properties of an elastic resistance band, an exercise device according to this disclosure can be used to determine an RFD corresponding to multiple movement angles (i.e., a full range of movement), that is independent of gravity, does not have inertia issues, and measures the force applied by the user. For example, an elastic resistance band is independent of gravity because the resistive force of the band depends on the elastic properties of the band itself and not gravity, as with free-weight apparatus described with respect to FIG. 18.

Figure 19:
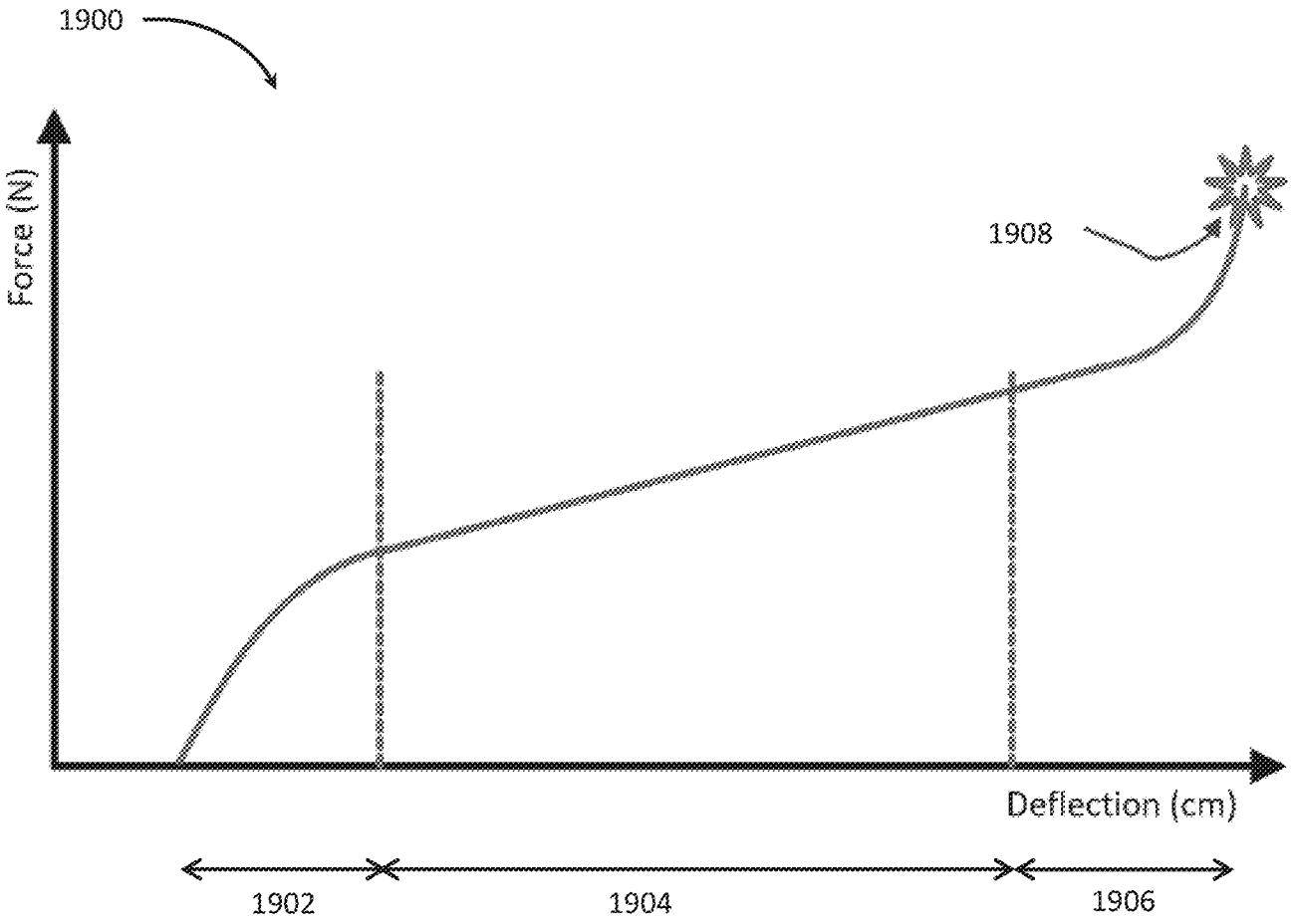
FIG. 19 is a force-deflection curve of an elastic resistance component in accordance with embodiments of the present disclosure

FIG. 19 illustrates a force-deflection curve 1900 of an exemplary elastic resistance component (e.g., elastic resistance band). Region 1902 illustrates the force required to overcome the material stiffness of the elastic resistance component. In region 1904, the force response plot follows a linear range, i.e., an incremental change in force will result in a consistent incremental change in deflection of the elastic resistance component (e.g., stretching). This linear range 1904 is the region commonly used during fitness exercises. Region 1906 shows the force applied to the elastic resistance component as the elastic resistance component reaches the limit of material elongation. Point 1908 shows application of force leading to material failure.

Figure 20:
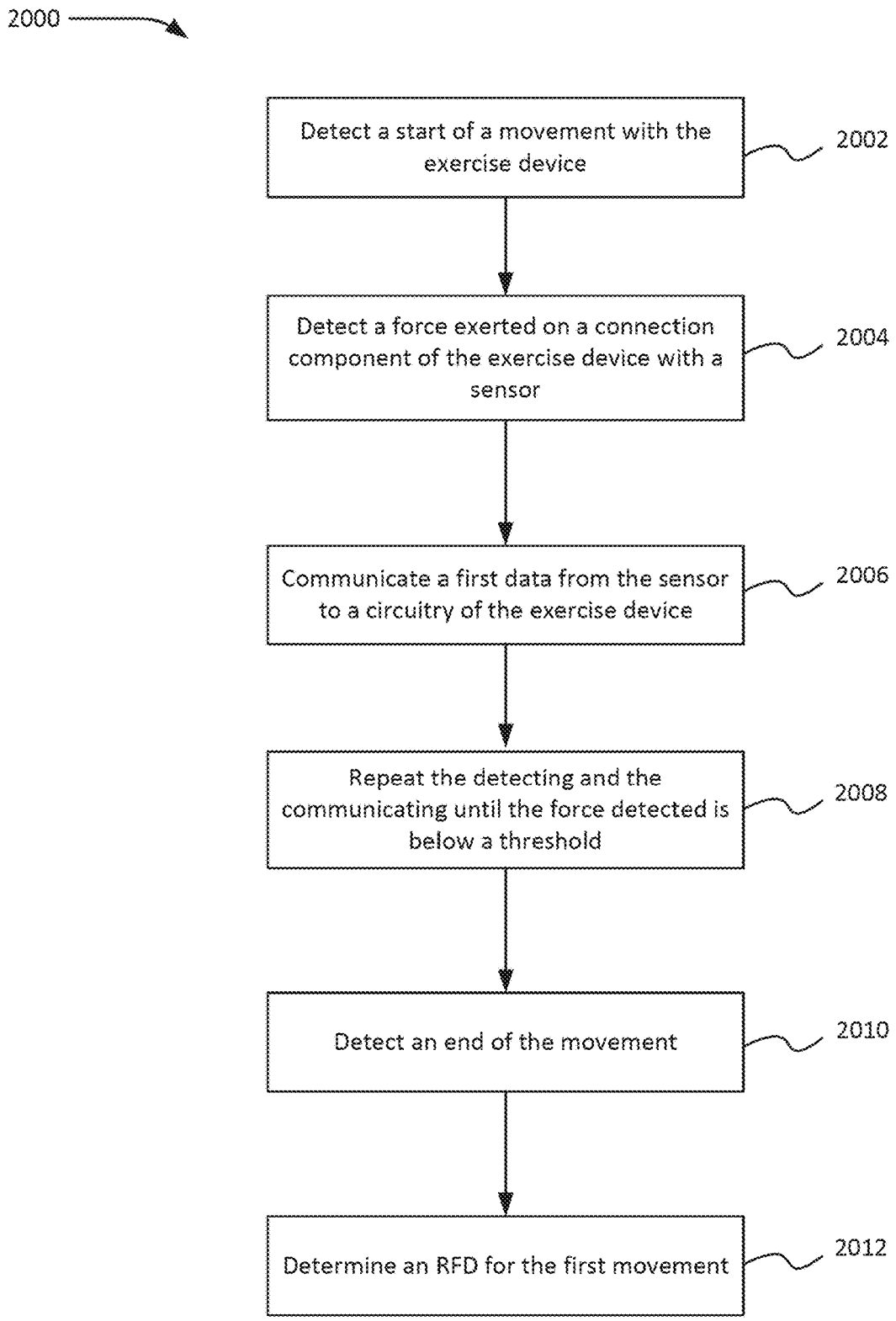
FIG. 20 is a flow chart for determining RFD in accordance with embodiments of the disclosure.

FIG. 20 is a flow chart 2000 for calculating RFD using an exercise device, e.g., exercise device 1400 coupled to an elastic resistance component/band in accordance with embodiments of the present disclosure. An elastic resistance component may exert a force on a connection component of the exercise device indicating a start of an exercise movement 2002. A sensor such as a load cell detects the force exerted on connection component 2004. The load cell communicates a first signal or first data indicative of the force exerted on connection component 2004 to the processing unit, e.g., a microcontroller disposed on the processing unit 2006. The detecting and communicating may be repeated 2008 until the processing unit determines the movement is complete 2010. In some embodiments the processing unit will determine an end of a movement if the first data indicates a rate in change of force that is below a threshold. The threshold may be a positive, a zero, or negative value. The processing unit can determine an RFD for a first movement based on the data received from the load cell 2012.

Figure 21:
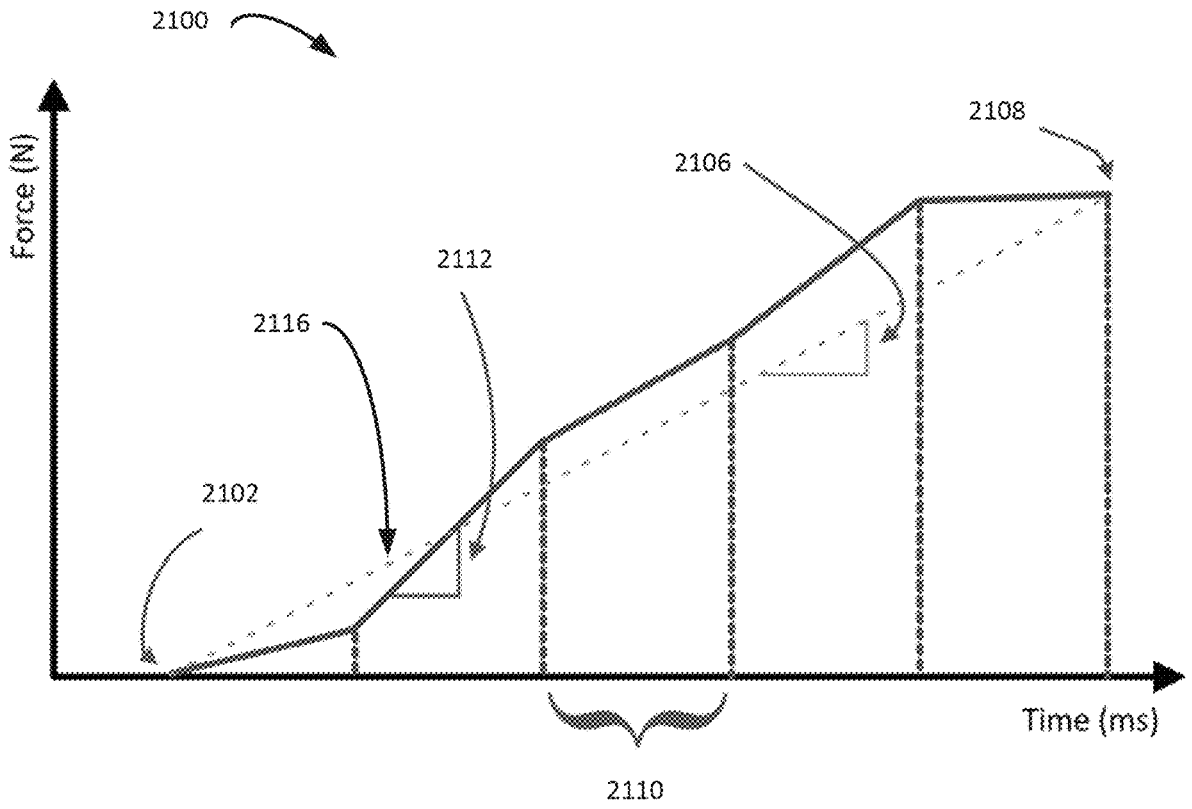
FIG. 21 is a plot showing force over time from the start of a movement to an end of a movement in accordance with embodiments of the present disclosure.

In some embodiments, the RFD can be calculated by directly measuring a change in force over time. FIG. 21 shows an exemplary plot 2100 showing force over time from the start of a movement 2102 to an end of a movement 2108. The force may be sampled at a sampling interval 2110. The sampling interval 2110 may correspond to a time range of 10 ms-50 ms. In some embodiments RFD may be calculated as an average rate of change of force 2106. The average RFD 2106 corresponds to the total change in force over the total time from the start 2102 to the end of the movement 2108. In other words, the average RFD 2106 is the slope of a line 2116 connecting the force detected at the start of movement 2102 and the force detected at the end of movement 2108.

In some embodiments, the determined RFD is an average RFD over a limited range such as 10-90%, 20-80%, 30-70% of the range of motion from the start of a movement 2102 to an end of the movement 2108. In other embodiments, the RFD is determined as a peak RFD 2112. The peak RFD 2112 is determined by sampling a force at a regular time interval, e.g., sample interval 2110, determining an average RFD for each sample interval, comparing the average RFD for each sample interval, and selecting the sample interval with the highest average RFD as the determined RFD. Referring to FIG. 21, this corresponds to the slope of line 2104 indicated at 2112. In some embodiments the processing unit will include a timer to monitor the change in time.

According to another embodiment, RFD is calculated by measuring a displacement of the exercise device 1400 due to the change in length of the elastic resistance component. Referring again to FIG. 19, most exercise movement with the band occurs in the linear range 1904. Due to the linear relationship between force and displacement, the change in force is proportional to the change in distance over the linear range 1904. To calculate RFD, the change in distance over the change in time is multiplied by the elastic modulus (E) of the resistance component. For example:

$$RFD = \frac{\Delta F}{\Delta t} = \frac{\Delta d}{\Delta t} E = \text{velocity} \times E$$

If the total change in distance is taken over the time from the start of a movement to the end of the movement, the average RFD is equal to the velocity multiplied by the elastic modulus of the resistance component. For example:

$$\text{RFD}_{avg} = \text{velocity}_{avg} \times E$$

This method of RFD relies on the elastic characteristics of the resistance component unlike the isometric mid-thigh pull and free-weight methods.

Figure 22:
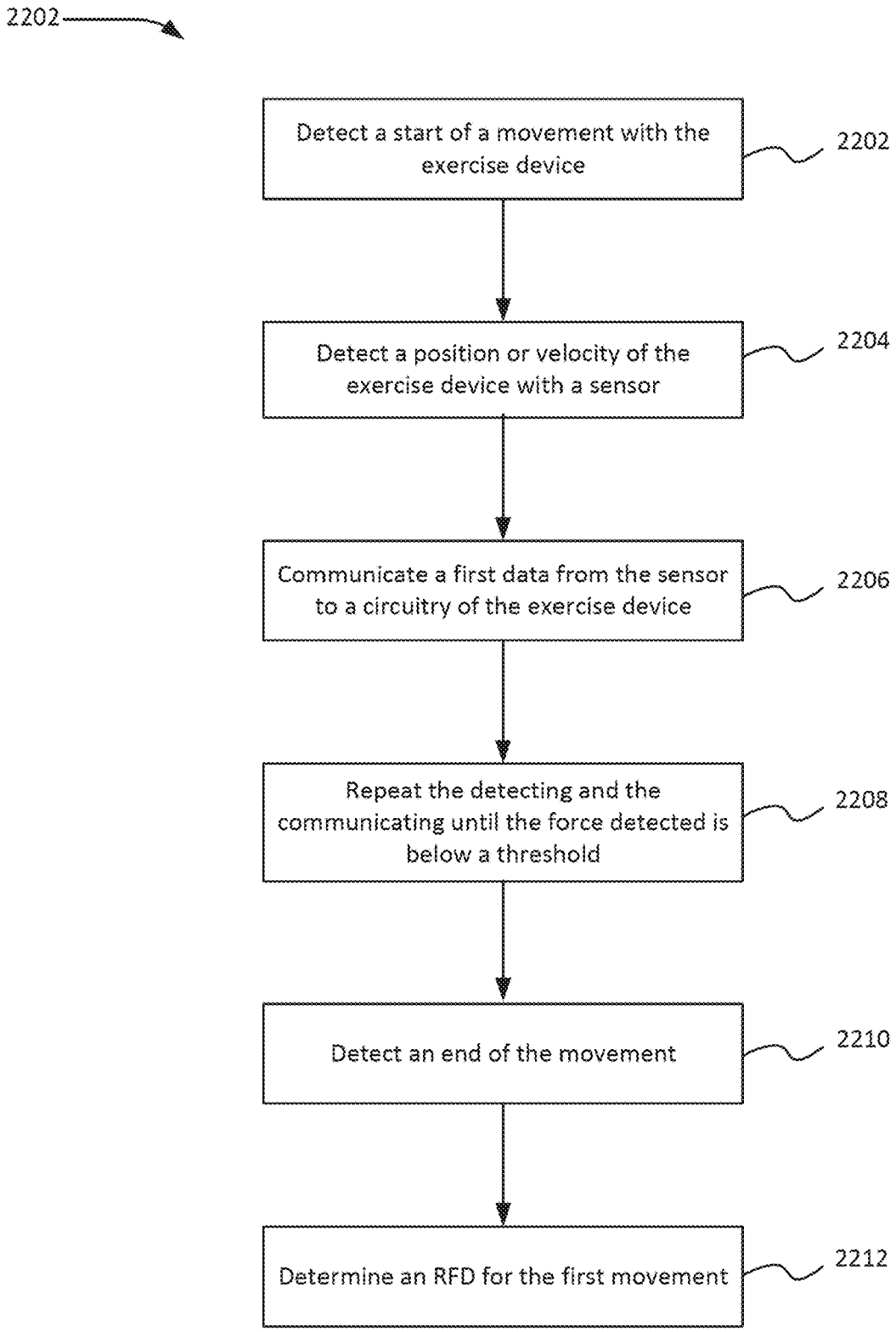
FIG. 22 is a flow chart for determining RFD in accordance with embodiments of this disclosure.

FIG. 22 illustrates a flow chart 2200 for calculating RFD in accordance with embodiments of the disclosure. The exercise device can detect a start of a movement 2202. A sensor such as an accelerometer or a linear displacement sensor can detect a data or signal corresponding to a velocity or first position of the exercise device, respectively 2204, at the start of the movement. The data is communicated to the processing unit 2206. The detecting and the communicating may be repeated 2208 until the end of the movement is detected 2210. In some embodiments the processing unit may determine an end of a movement if the first data indicates a rate in change of force that is below a threshold. The threshold may be a positive, a zero, or negative value. The velocity and/or position data may be sampled at a regular interval, e.g., an interval of 10 ms-50 ms.

The processing unit may then determine RFD for the first movement 2212. The RFD can be determined based on the position or velocity data. In some embodiments, the processing unit determines the RFD by multiplying the velocity measured by an accelerometer by the elastic modulus of the resistance component. The elastic modulus of the resistance component may be determined according to the method discussed above under the calibration heading. In some embodiments, the processing unit calculates the RFD by dividing a change in distance measured by a linear displacement sensor by a change in time, which is then multiplied by the elastic modulus of the resistance component.

The RFD calculations based on velocity and distance can be performed over the entire range of motion from the start of the motion to the end of the motion in order to obtain an average RFD. In some embodiments the calculations are performed at intervals to calculate an RFD for discrete time intervals to obtain a peak RFD as described with respect to FIG. 21 above. In some embodiments, the processing unit may include a timer to monitor the change in time. The elastic modulus of the resistance component may be determined by the calibration method described above.

Due to the properties of an elastic resistance component, RFD for an exercise movement utilizing an elastic resistance component can be calculated across a full range of motion. Additionally, performing exercise movements using elastic resistance components are not subject to inertia. Further, according to embodiments of the present disclosure the exercise device directly measures force. Further still, the exercise device is portable, which allows individuals to carry the exercise device to easily adapt a training room or equipment to determine RFD of a movement.

An exercise device in accordance with the present disclosure may include a body having a first end and a second end, wherein a first end is configured to receive a handle attachment. The exercise device may also include a first connection component disposed at the second end of the body and configured to attach the exercise device to a first resistance component. A sensor may be coupled to the first connection component. Additionally, a processing circuit may be disposed in the body of the exercise device communicatively coupled to the sensor and configured to directly determine the force exerted by a user. The exercise device may also include a rotatable display communicatively coupled to the processing circuit and configured to rotate along one or more axes. In some embodiments, the rotatable display is configured to be visible to a user while performing the movement. In some embodiments, the sensor is a load cell. In some embodiments, the first resistance component is an elastic band.

An exercise device in accordance with embodiments of the present disclosure may be programmed to be communicatively coupled to a mobile device. The mobile device may be a smart phone, tablet, computer, or the like. According to some embodiments, the exercise device may be configured to be used with a second exercise device of a similar type. Specifically, the exercise device and second exercise device may be synchronized with the mobile device. The exercise device and second exercise device may be programmed to receive configuration commands from the mobile device. The exercise device and second exercise device may be configured to send telemetry to the mobile device for post-processing of data. In some embodiments, the post-processing of data includes comparing a first telemetry data received from the exercise device used by a first user with a second telemetry data received from the second exercise device used by a second user. In some embodiments, the post processing of data occurs in real time. However, one skilled in the art will understand that any number of exercise devices may be communicatively coupled to a mobile device.

In some embodiments, the processing circuit of the exercise device is configured to determine a first RFD, wherein the first RFD is independent of gravity. In some embodiments, the exercise device is configured to determine an RFD for multiple movement angles. For example, the processing circuit is configured to determine a second rate of force development and wherein the first RFD corresponds to a first movement performed at a first angle and the second RFD corresponds to a second movement performed at a second angle.

In some embodiments, the first RFD is based on a detected change in force over a change in time. In some embodiments, the processing circuit of the exercise device is programmed to determine an RFD based on a calculated RFD for a plurality of sampling intervals during the movement, compare each calculated RFD for the plurality of sampling intervals, and select a RFD value corresponding to a sampling interval with a highest RFD.

An exercise device in accordance with embodiments of the present disclosure may be programmed to determine a target weight corresponding to a peak position of the movement. Specifically, the exercise device is programmed to receive an input of a desired target weight, detect a change in weight as a user changes a length of the resistance component during the movement, and provide the user with feedback when the target weight is detected. The feedback may be audio feedback or haptic feedback. For example, the exercise device may further include an audio device or haptic device. In some embodiments, the exercise device may be programmed to detect a change in force during a movement, subtract a hysteresis value from the target weight once a detected force equals the target weight, increment a time-under-tension clock, and stop the time-under-tension clock when the detected force is less than the hysteresis value subtracted from the target weight.

In some embodiments, the exercise device includes a rotatable handle with a flexible strap attached to the first end of the body. A rotatable spindle may be disposed on the flexible strap. A handle grip may be disposed over the rotatable spindle, such that the handle grip has an ergonomic design.

Methods of using an exercise device in accordance with embodiments of the present disclosure include detecting a first data at a first sensor, wherein the first data is indicative of a first movement, wherein the movement is performed with the exercise device and a first resistance component coupled to the exercise device. The first data may be communicated to a processing circuit. The detecting and the communicating may be repeated until the first movement is complete. The exercise device may determine a first force generated by the first movement and display the first force to a user with a rotatable display on the exercise device. In some embodiments, the end of the first movement may include determining the rate in change of force of the first movement is below a threshold. In some embodiments the first force may be displayed to the user with a rotatable display such that the display is visible to the user while the movement is performed.

In some embodiments, determining a first force generated by the movement may include detecting a change in the first force during the movement. A hysteresis value may be subtracted from the target weight once a detected force equals the target weight. A time-under-tension clock may then be incremented. The time-under-tension clock may be stopped when the detected force is less than the hysteresis value subtracted from the target weight.

In some embodiments, methods of using the exercise device may include calibrating the exercise device for a target weight. For example, the exercise device may receive an input of a desired target weight. The exercise device may detect a change in weight as the user changes a length of the resistance component during the movement. The exercise device may provide the user with feedback when the target weight is detected. The peak position of the movement should correspond to the target weight being detected by the exercise device. The feedback may be audio or haptic feedback. Once the device is calibrated, a user may perform repetitions of the exercise movement. During the repetitions, the exercise device will detect a change in weight as the user changes a length of the resistance component during a second movement and provide the user with feedback indicating the target weight is detected.

In some embodiments, methods of using the exercise device may include synchronizing operation of the exercise device and second exercise device with the mobile device. This enables the exercise device to be used simultaneously with a second exercise device of similar type. According to this method, the exercise device and second exercise device may receive configuration commands from the mobile device. The first exercise device may also send a first telemetry data to the mobile device. Similarly, second telemetry data from the second exercise device may be sent to the mobile device. The mobile device may then perform post-processing with the first and second telemetry data. Specifically, the mobile device may compare the first and second telemetry data. In some embodiments, the post-processed data may be displayed with the mobile device. In some embodiments, the post-processing occurs in real time.

In some embodiments methods of using the exercise device may include determining a first RFD, wherein the first RFD is independent of gravity. In some methods of use, the RFD may be determined for multiple movement angles. For example, the first RFD may correspond to a first movement performed at a first angle and the second RFD may correspond to a second movement performed at a second angle. In some embodiments, determining a first RFD includes calculating a change in the first force over a change in time. According to some embodiments, determining the first RFD includes calculating sample RFDs for a plurality of sampling intervals during the first movement. The each calculated sample RFDs for the plurality of sampling intervals may be compared and the exercise device may select the first RFD to correspond to a sampling interval with the highest sample RFD.

Although examples of this disclosure have been fully described with reference to the accompanying drawings, it is to be noted that various changes and modifications will become apparent to those skilled in the art. Such changes and modifications are to be understood as being included within the scope of examples of this disclosure as defined by the appended claims.

The invention claimed is:

1. An exercise device comprising:

a body having a first end and a second end, wherein the first end is configured to receive a handle attachment;

a first connection component disposed at the second end of the body and configured to attach the exercise device to a first resistance component, a sensor coupled to the first connection component;

a processing circuit disposed in the body of the exercise device communicatively coupled to the sensor; and a rotatable display communicatively coupled to the processing circuit and configured to rotate along one or more axes and display information based on an output of the sensor, wherein the processing circuit is programmed to:

detect a change in force during a movement of the exercise device;

subtract a hysteresis value from a target force once a detected force equals the target force;

while the detected force is above the target force less the hysteresis value, increment a time-under-tension clock; and in response to detecting that the detected force falls below the target force less the hysteresis value, stop the time-under-tension clock.

2. The exercise device of claim 1, wherein the first resistance component is an elastic band.

3. The exercise device of claim 1, wherein the exercise device is programmed to:

receive an input of a desired target force;

detect, using the sensor, a change in force as a user changes a length of the first resistance component during a movement of the exercise device; and provide the user with feedback, using the rotatable display, when the desired target force is detected.

4. The exercise device of claim 1, wherein the exercise device is configured to be communicatively coupled to a mobile device, which is communicatively coupled to a second exercise device, wherein the exercise device is programmed to:

synchronize with the mobile device and the second exercise device;

receive a first command from the mobile device to set a first target force, wherein the mobile device sends a second command to the second exercise device setting the first target force; and send an output of the sensor of the exercise device to the mobile device.

5. The exercise device of claim 1, wherein the processing circuit is programmed to determine a first rate of force development (RFD) of a first movement performed with the exercise device, wherein the first RFD rate of force development (RFD) is independent of gravity.

6. The exercise device of claim 5, wherein the processing circuit is programmed to determine the first rate of force development (RFD) for movements performed at multiple angles.

7. The exercise device of claim 5, wherein the processing circuit is programmed to determine the first rate of force development (RFD) based on a change in force of the first movement over a length of time corresponding to a duration of the first movement.

8. The exercise device of claim 5, wherein the processing circuit is programmed to:

determine the first rate of force development (RFD) based on a calculated rate of force development (RFD) for a plurality of sampling intervals during the first movement of the exercise device;

compare each calculated rate of force development (RFD) for the plurality of sampling intervals; and select the first rate of force development (RFD) to be the calculated rate of force development (RFD) corresponding to a sampling interval with a highest calculated rate of force development (RFD).

9. The exercise device of claim 1, wherein the rotatable display is rotatable to be visible to a user while using the exercise device.

* * * * *